US007416435B2

(12) United States Patent
Onogi

(10) Patent No.: US 7,416,435 B2
(45) Date of Patent: Aug. 26, 2008

(54) CABLE FIXTURE FOR MOUNTING A CABLE TO AN ELECTRONIC APPARATUS

(75) Inventor: Yu Onogi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/693,578

(22) Filed: Mar. 29, 2007

(65) Prior Publication Data

US 2007/0232128 A1 Oct. 4, 2007

(30) Foreign Application Priority Data

Mar. 31, 2006 (JP) ..... 2006-099647

(51) Int. Cl.
*H01R 13/56* (2006.01)

(52) U.S. Cl. ..... 439/445

(58) Field of Classification Search ..... 439/445, 439/435, 422, 108, 442, 385, 371
See application file for complete search history.

(56) References Cited

U.S. PATENT DOCUMENTS 5,464,352 A * 11/1995 Van Emmerick ..... 439/404
6,692,294 B2 * 2/2004 Kobayashi ..... 439/496
2005/0112915 A1 * 5/2005 Mueller ..... 439/76.1
2007/0137882 A1 * 6/2007 Journeaux et al. ..... 174/135

FOREIGN PATENT DOCUMENTS

JP 2004-239325 8/2004

* cited by examiner

*Primary Examiner*—Chandrika Prasad
(74) *Attorney, Agent, or Firm*—Finnegan, Henderson, Farabow, Garrett & Dunner, L.L.P.

(57) ABSTRACT

A cable fixture including a holding section for holding a cable relative to a chassis; and a fitting section formed integrally with the holding section and operative to fix the holding section to the chassis, wherein the cable is fitted, from one side, to and hooked on a hole provided in the vicinity of an opening formed in the chassis for permitting the cable to pass therethrough, by the fitting sections provided at both end portions of the holding section, and the wiring direction of the cable fixed by the holding section coincides substantially with the fixing direction in fixation of the chassis by the fitting sections.

4 Claims, 23 Drawing Sheets

SECTION A-A

SIDE VIEW

CABLE FIXTURE FOR MOUNTING A CABLE TO AN ELECTRONIC APPARATUS

CROSS REFERENCES TO RELATED APPLICATIONS

The present invention contains subject matter related to Japanese Patent Application JP 2006-099647, filed in the Japan Patent Office on Mar. 31, 2006, the entire contents of which being incorporated herein by reference.

BACKGROUND OF THE INVENTION

1. Field of the Invention

The present invention relates to a cable fixture used for mounting a cable and the like to a chassis of an electronic apparatus or the like.

2. Description of the Related Art

As a cable fixture for fixing a flat cable to a chassis fabricated from sheet metal, there is known a fixture disclosed in Japanese Patent Laid-open No. 2004-239325, hereinafter referred as Patent Document 1.

Patent Document 1 describes a fixture which is used for mounting electronic parts, cables and the like to a chassis of an electronic apparatus or the like and which permits a detaching operation to be easily carried out from the face side of the chassis.

The fixture has a holding section for holding a component part onto the chassis, and a fitting section which is provided as one body with the holding section and which is for fixing the holding section to the chassis. The fitting section has a base having a flat bottom surface capable of making contact with the face of the chassis, a clamping piece projected on the bottom surface of the base and fitted from one direction to an inner edge part of a hole provided in the chassis so as to clamp the inner edge part, and a lock body projected on the bottom surface of the base and engaged with an inner edge part of a hole provided in the chassis so as to lock the base from moving in the opposite direction.

This configuration ensures that the operations for mounting and dismounting the fixture onto and from the chassis can be carried out easily.

On the other hand, inside an electronic apparatus, there are cases where a ground line provided in a cable should be grounded or insulated by joining the ground line to a chassis or a shielding sheet metal (hereinafter referred to as "the shield sheet metal") at an arbitrary position. For example, in order to cope with EMC (Electro-Magnetic Compatibility), a transfer from conductive connection to an insulated condition in a fixed condition may be performed between the shield sheet metal and the cable, or a transfer from the insulated condition to the conductive connection at that location may be performed.

There are cases where a wire harness (hereinafter referred to as "the harness") obtained by adjusting and combining the length of wires, the number of wires and terminating treatments to complete a single component part which can be easily attached to an apparatus is to be put into conductive connection between locations, between which a current is to be passed, of a sheet metal used for an electronic apparatus casing or the like. In such a case, there has been a need to provide the harness substantially in parallel to the surface of the sheet metal. This arrangement is adopted because, where the harness is substantially parallel to the sheet metal, the desired conduction can be secured by pressing the harness against the sheet metal by use of existing clampers.

On the other hand, where the harness is so disposed that its wiring direction is substantially orthogonal to the surface of the sheet metal, there is a need to partly deform the harness so as to be substantially parallel to the sheet metal, or to deform the sheet metal so as to obtain a parallel relationship.

In the former approach, the harness is deformed, so that a mechanical stress may be generated in the harness itself or in a connector or a device connected with the harness, and it may be necessary to cope with this problem. On the other hand, in the latter approach, no mechanical stress is exerted on the harness, but there is a need to modify the die for forming the sheet metal in coping with the EMC, so that the coping with this problem takes more time and cost.

Here, the EMC includes both the condition where EMC (Electro Magnetic Interference) possibly serving as an interference source of not less than a certain level against external apparatuses is not generated and the condition where such EMS (Electro Magnetic susceptibility) that the operations of the relevant apparatus itself are not hampered by external electromagnetic waves.

There are cases where the harness is disposed so that its wiring direction is substantially orthogonal to the surface of the sheet metal and where there is a need to cope with EMC. For example, there is a case where a flexible cable for connection between a device and a connector is passed through an opening part of the shield sheet metal, there is a need to provide conductive connection between the cable and the shield sheet metal for coping with EMC, and, further, a deformation of the flexible cable to put it into conductive connection to the shield sheet metal would exert a heavy stress on the flexible cable, possibly causing a reduction in device performance. In such a case, the following measure has been adopted.

A configuration has been adopted in which two conductive elastic bodies are disposed, without any gap therebetween, in an opening part of a shield sheet metal through which a flexible cable is passed, the flexible cable is passed between the two conductive elastic bodies, conductive connection between the flexible cable and the conductive elastic bodies is secured by the elasticity of the conductive elastic bodies, and, further, the conductive elastic bodies are fixed to the shield sheet metal by use of a conductive adhesive double coated tape, thereby securing conductive connection between the shield sheet metal and the flexible cable.

SUMMARY OF THE INVENTION

However, in the case where the cable is so disposed that its wiring direction is substantially orthogonal to the surface of the sheet metal and there is a need to cope with EMC, the techniques known in the past adopt the fixation of the two conductive elastic bodies to the shield sheet metal by use of a conductive adhesive double coated tape. Therefore, the condition of the conductive connection varies greatly, depending on the application of the conductive adhesive double coated tape to the shield sheet metal in fixation, with the result that the EMC performance varies from apparatus to apparatus.

Thus, there is a need for a cable fixture by which a cable can be fixed without exerting any mechanical stress thereon and it is possible to flexibly cope with EMC without any influence on time or cost, in the case where the cable is disposed with its wiring direction substantially orthogonal to the surface of a sheet metal and there is a need to cope with EMC.

According to an embodiment of the present invention, there is provided a cable fixture including a holding section for holding a cable relative to a chassis, and a fitting section formed integrally with the holding section and operative to fix the holding section to the chassis, wherein the cable is fitted, from one side, to and hooked on a hole provided in the vicinity of an opening formed in the chassis for permitting the cable to pass therethrough, by the fitting sections provided at both end portions of the holding section; and the wiring direction of the cable fixed by the holding section coincides substantially with the fixing direction in fixation of the chassis by the fitting sections.

According to the cable fixture in the present invention configured as above, the cable led into the inside of the chassis so that its wiring direction is substantially orthogonal to the opening in the chassis can be fixed in the vicinity of the opening in the chassis.

According to the cable fixture in the present invention, therefore, a cable can be fixed in the vicinity of an opening in a chassis, whereby the cable can be led into the inside of the chassis without exerting any mechanical stress on the cable.

BRIEF DESCRIPTION OF THE DRAWINGS

FIGS. 8A to 8D illustrate the structure of a cable clamp according to an embodiment of a cable clamp, which is the cable fixture in the present invention, wherein FIG. 8A is an overall view, FIG. 8B is a perspective view of a chassis lock section, FIG. 8C is a perspective view of a flat clamp section, and FIG. 8D is a perspective view showing the condition where the flat clamp section shown in FIG. 8C is closed;

FIGS. 9A to 9E illustrate examples of the form of the cable clamp in the example shown in FIG. 8A to 8D during its mounting, wherein FIG. 9A is a perspective view showing the condition of joint to a conductive elastic body, FIG. 9B is a perspective view showing the condition of attachment to the shield sheet metal, and FIGS. 9C and 9D are perspective views showing the cable clamp before and after fixation thereof to a flat cable;

FIGS. 15A and 15B illustrate, in a picked-up state, a base plate and a bottom wall of the bottom frame in the example shown in FIG. 14, wherein FIG. 15A is a front view, and FIG. 15B is a plan view;

FIGS. 17A to 17F illustrate a V adjusting piece, wherein FIG. 17A is a perspective view, FIG. 17B is a plan view, FIG. 17C is a plan sectional view, FIG. 17D is a left side view, FIG. 17E is a front view, and FIG. 17F is a back elevation;

FIGS. 21A to 21C show the condition where the optical unit mount plate is mounted to the base plate and the bottom wall in the example shown in FIGS. 15A and 15B, wherein FIG. 21A is a plan view, FIG. 21B is a sectional view along line A-A of FIG. 21A, and FIG. 21C is a side view;

FIGS. 22A to 22F illustrate an R adjusting piece in the example shown in FIGS. 12A to 12C, wherein FIG. 22A is a perspective view, FIG. 22B is a plan view, FIG. 22C is a front view, FIG. 22D is a right side sectional view, FIG. 22E is a right side view, and FIG. 22F is a back elevation; and FIGS. 23A to 22D illustrate the adjustment by the R adjusting piece in adjustment of the position of the optical unit mount plate mounted to the base plate and the bottom wall in the example shown in FIG. 15, wherein FIG. 23A shows the condition before adjustment.

DETAILED DESCRIPTION OF THE PREFERRED EMBODIMENT

An embodiment of the cable fixture in the present invention will be described referring to FIGS. 1 to 23. In the following, description will be made of an example of application of the cable fixture in this embodiment to a rear projection display apparatus taken as an electronic apparatus in which the cable fixture is used.

Figure 1:
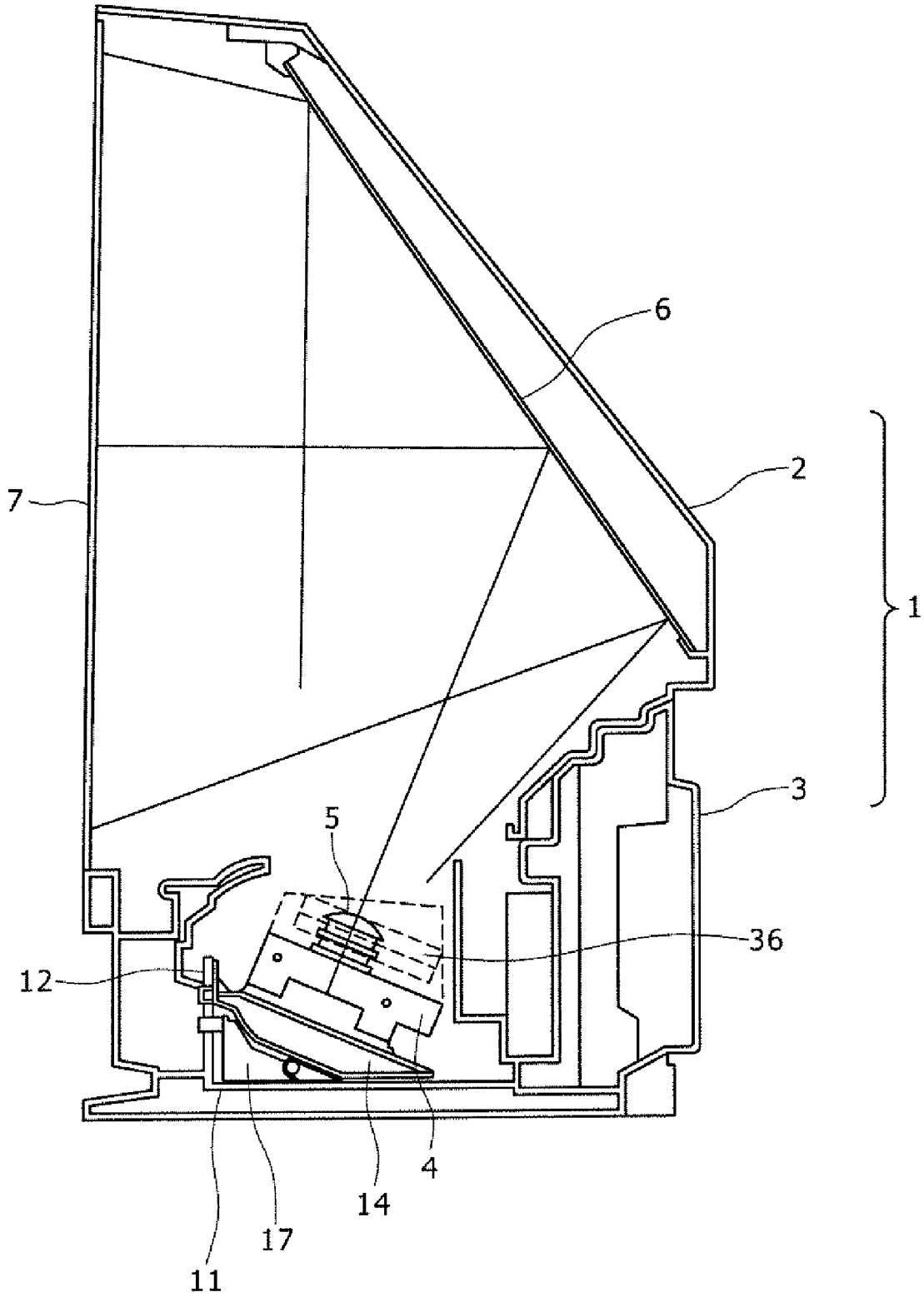
FIG. 1 is an inside configuration diagram of a rear projection display apparatus in which a cable fixture according to an embodiment of the present invention is used.
Figure 2:
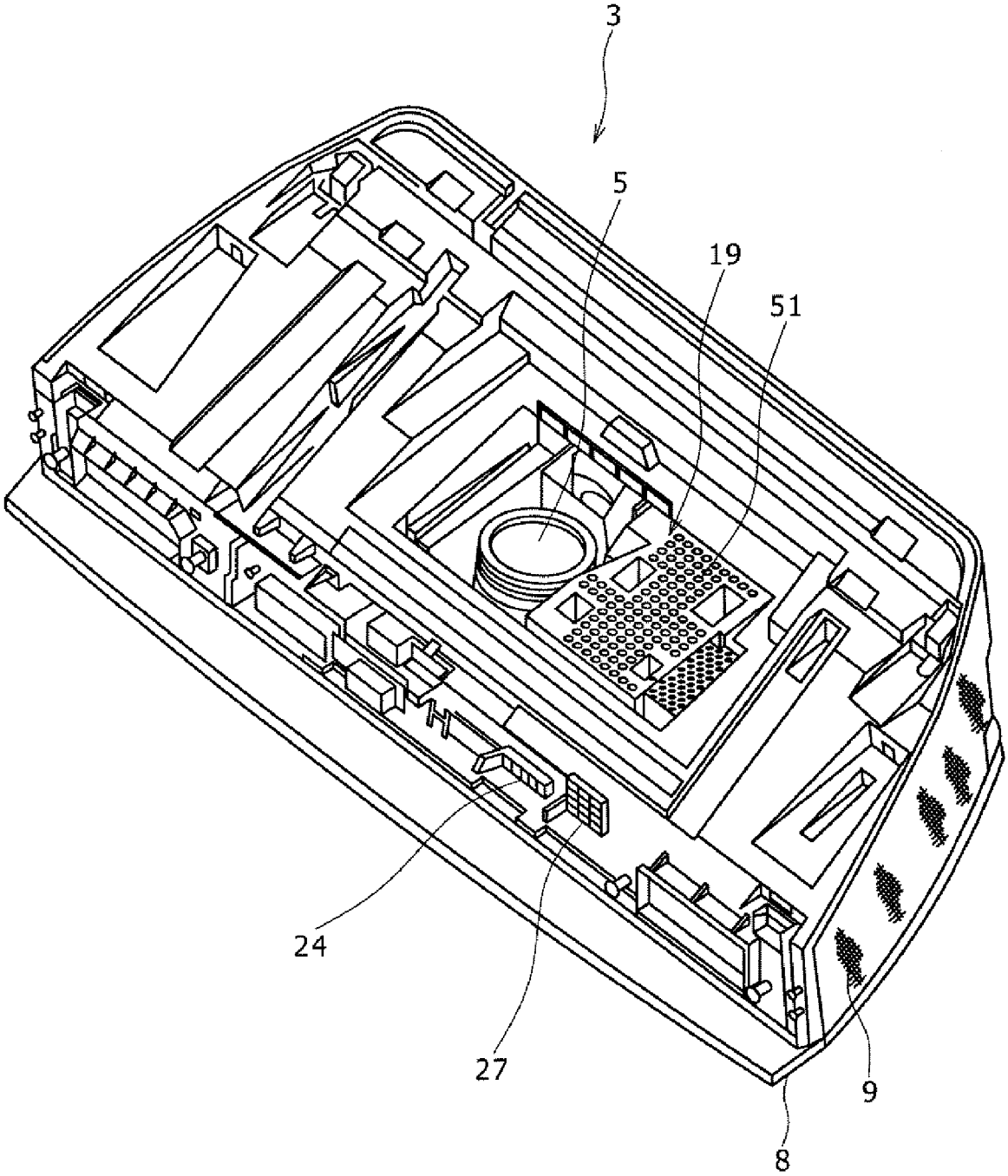
FIG. 2 is a perspective view of a bottom cabinet of the rear projection display apparatus in the example shown in FIG. 1.

FIG. 1 is a side view showing the total inside configuration of a rear projection display apparatus, and FIG. 2 is a perspective view of a bottom cabinet.

A cabinet 1 constituting a housing of the rear projection display apparatus has a bisected configuration composed of a top cabinet 2 on the upper side in FIG. 1 and a bottom cabinet 3 on the lower side. A reflecting mirror 6 and a screen 7 are provided in the top cabinet 2, whereas an optical unit 4 for modulating a luminous flux emitted from a light source (not shown), forming an optical image according to picture information and enlargingly projecting the optical image via a projection lens 5 is disposed in the bottom cabinet 3. The optical image enlargedly projected from the projection lens 5 is reflected by the reflecting mirror 6 disposed skewly in the top cabinet 2, to be projected on the screen 7 at the front face of the cabinet 1.

FIG. 2 is a perspective view of the bottom cabinet 3. As shown in the figure, the bottom cabinet 3 has a configuration in which the optical unit 4 (FIG. 1) including the projection lens 5, a power source, the light source, an exhaust fan and a control circuit are stored in the housing including a bottom frame 8 molded in a roughly angular U-shaped form from a plastic resin and a mesh cover 9 with its surface perforated in a mesh form for heat radiation.

As shown in FIG. 2, the bottom cabinet 3 is provided with an opening substantially in the center of an upper part thereof so that the projection lens 5 is exposed and that an optical unit storing section 19 having the optical unit 4 covered with a cover 51 is exposed.

In addition, the left lower side in FIG. 2, or the front side of the screen 7, of the bottom cabinet 3 is used as a user's console panel, where an IR sensor for remote control (not shown), input terminals for connection with AV apparatus, a V adjusting piece 24 and an R adjusting piece 27 are provided.

The V adjusting piece 24 and the R adjusting piece 27 are used for adjusting distortions in the image on the screen after assembly of the rear projection display apparatus.

Figure 3:
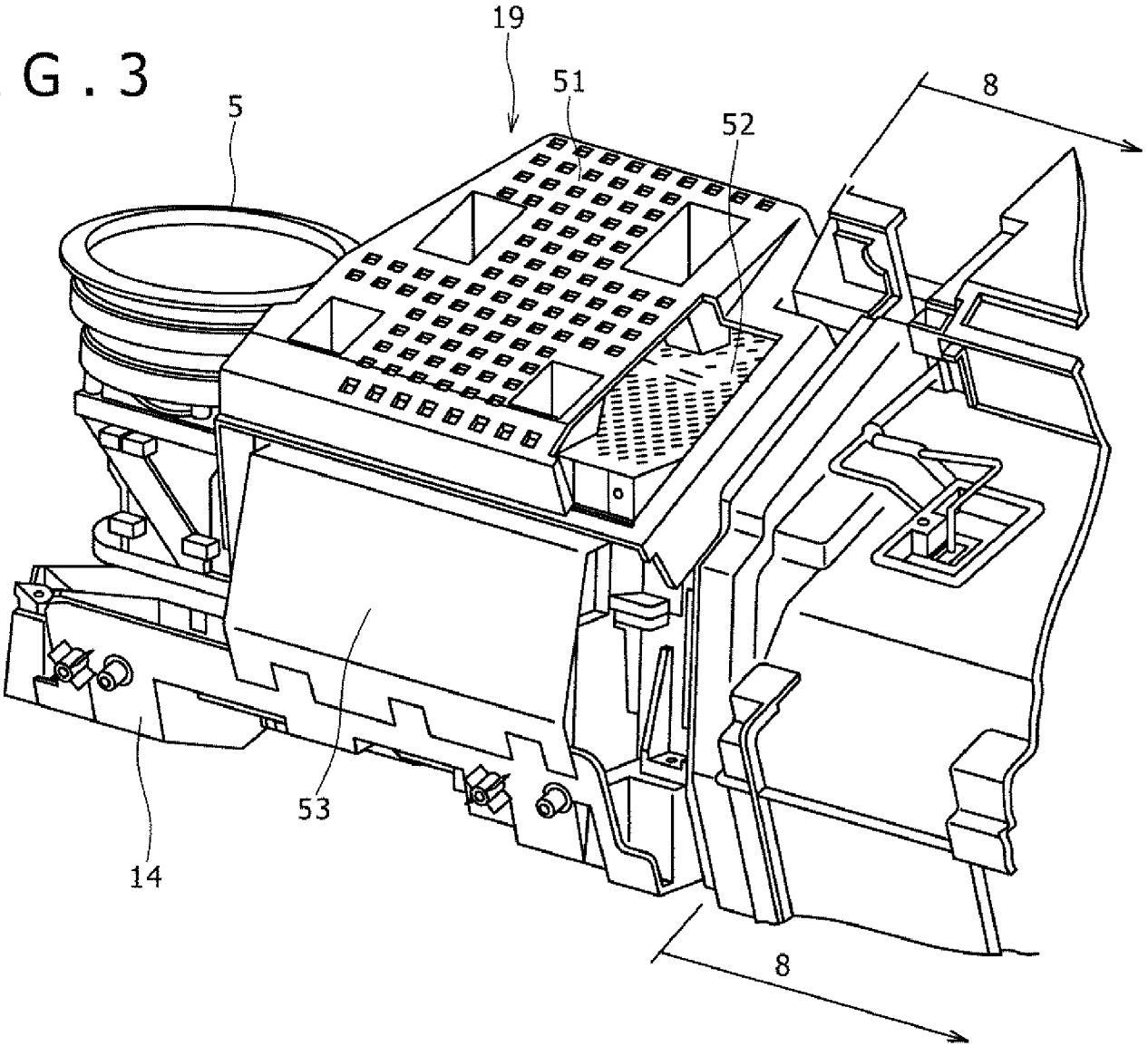
FIG. 3 is an enlarged perspective view showing the vicinity of an optical unit storing section of the bottom cabinet in the example shown in FIG. 2, in the condition of being drawn out to the exterior.

FIG. 3 is an enlarged perspective view showing, in a picked-up and enlarged state, the vicinity of the projection lens 5 and the optical unit storing section 19, which are exposed, in the bottom cabinet 3 shown in FIG. 2.

As shown in FIG. 3, the projection lens 5 and the optical unit storing section 19 are mounted on an optical unit mount plate 14. The outer periphery of the optical unit storing section 19 is covered with covers 52 and 53 in addition to the cover 51, for electromagnetic shielding, and the covers 51 and 52 disposed on the upper side are provided with many holes for heat radiation.

The optical unit 4 stored in the optical unit storing section 19 will be described below, referring to FIGS. 3 to 7.

Figure 4:
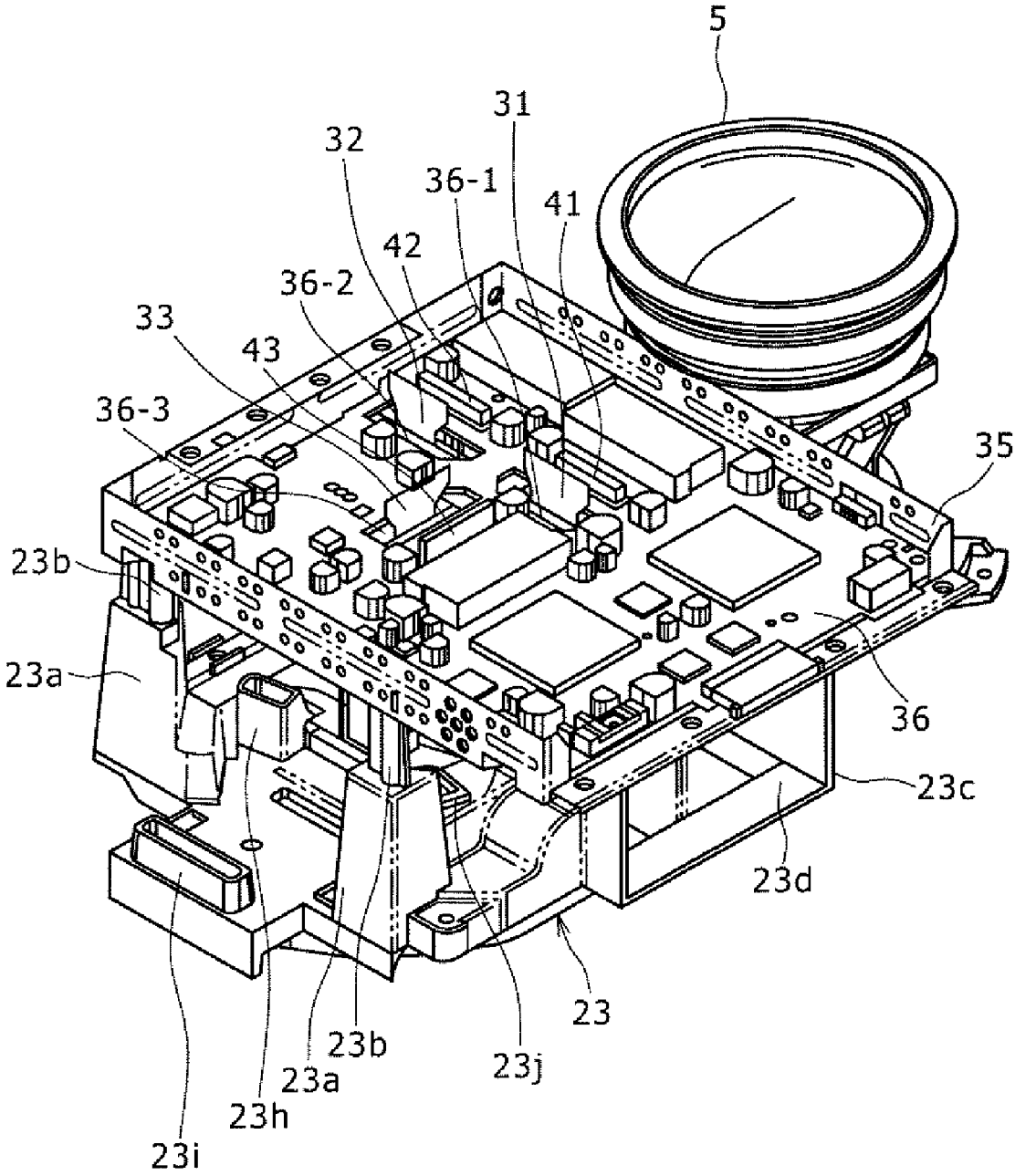
FIG. 4 is a perspective view showing the optical unit storing section in the example shown in FIG. 3, in the condition where a cover is removed.

FIG. 4 is a perspective view of the optical unit 4, showing the condition where the projection lens 5 and the optical unit storing section 19 shown in FIG. 3 are drawn out, the covers 51, 52 and 53 are detached, and the optical unit mount plate 14 is removed.

In the condition where the perforated covers 51 and 52 are removed, a shield sheet metal 35 with a liquid crystal panel control substrate 36 mounted thereon is disposed in proximity to the projection lens 5.

The liquid crystal panel control substrate 36 is provided with three openings 36-1 to 36-3 which are roughly rectangular in shape, and control circuit parts corresponding respectively to the three primary colors of light, namely, R (red), G (green) and B (blue) are mounted on the liquid crystal panel control substrate 36. In addition, one-side ends of an R flexible cable 31, a G flexible cable 32 and a B flexible cable 33 composed of flexible flat cables (FPCs) are connected respectively to three FPC connectors 41, 42 and 43 on the liquid crystal panel control substrate 36, and their other-side ends are connected respectively to an R signal liquid crystal panel, a G signal liquid crystal panel and a B signal liquid crystal panel. Here, metal wirings serving as ground lines are formed on one-surface sides of the flexible cables 31, 32 and 33, and the three FPC connectors 41, 42 and 43 are provided in the vicinity of one-side major edges of the three openings 36-1 to 36-3, respectively.

Figure 5:
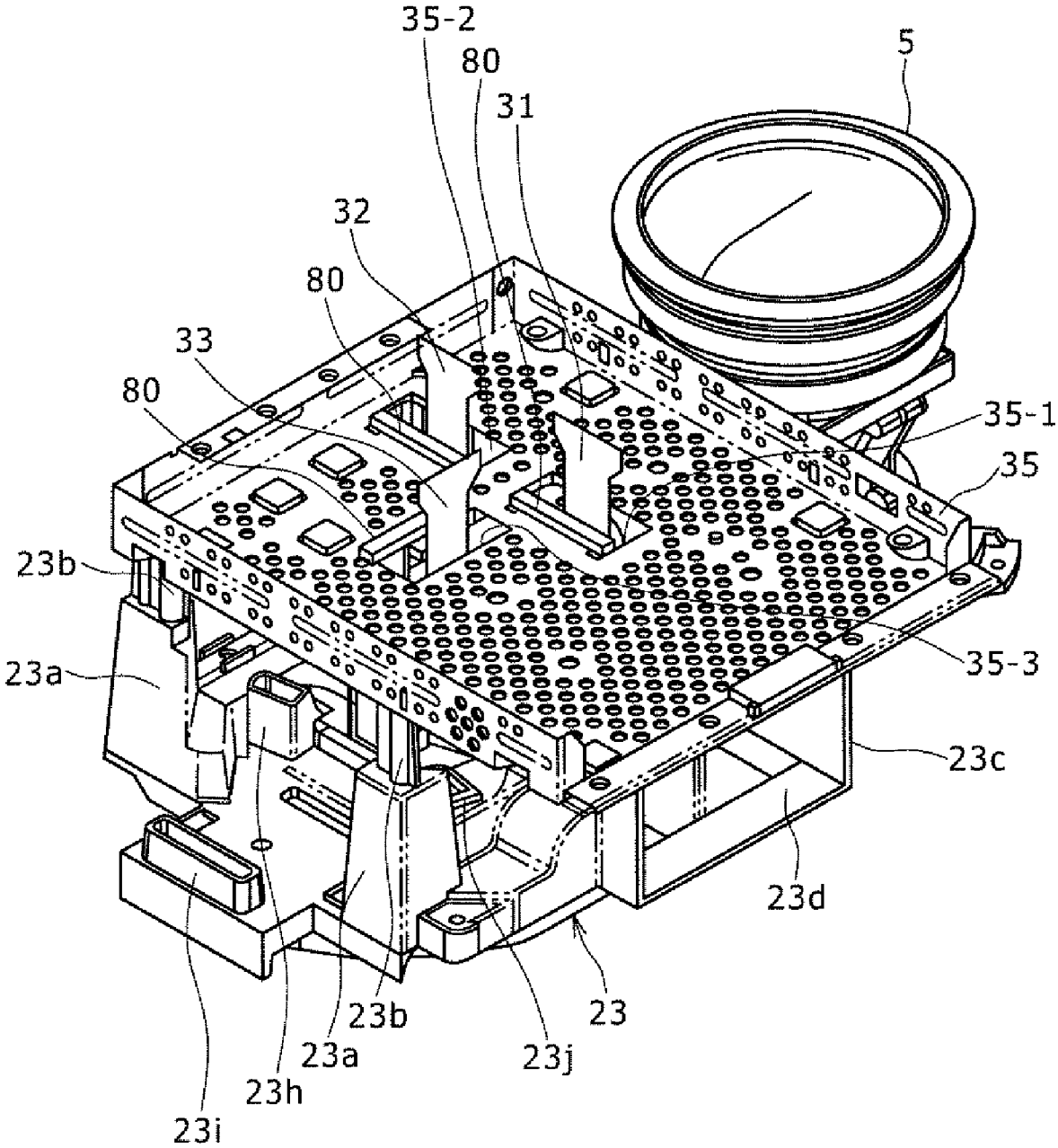
FIG. 5 is a perspective view showing a shield sheet metal in the condition where a circuit board is removed from the optical unit storing section in the example shown in FIG. 4.

In addition, as shown in FIG. 5 which is a perspective view of the shield sheet plate 35 in the condition where the liquid crystal panel control substrate 36 is removed, the shield sheet metal 35 is formed in a box-like shape from a perforated iron-based sheet metal, and its bottom surface part is provided with three roughly rectangular openings 35-1 to 35-3 through which to pass the flexible cables 31, 32 and 33. A total of three cable clamps 80, 80, 80 serving as cable fixtures are provided in the vicinity of one-side major edges of the openings 35-1 to 35-3. Incidentally, the three cable clamps 80, 80, 80 are provided with conductive elastic bodies 70 (described later), whereby the flexible cables 31, 32 and 33 are slacklessly fixed to the shield sheet metal 35, and the ground lines composed of the metal wirings on one-surface side of the flexible cables 31, 32 and 33 are put in conductive connection with the shield sheet metal 35.

Figure 6:
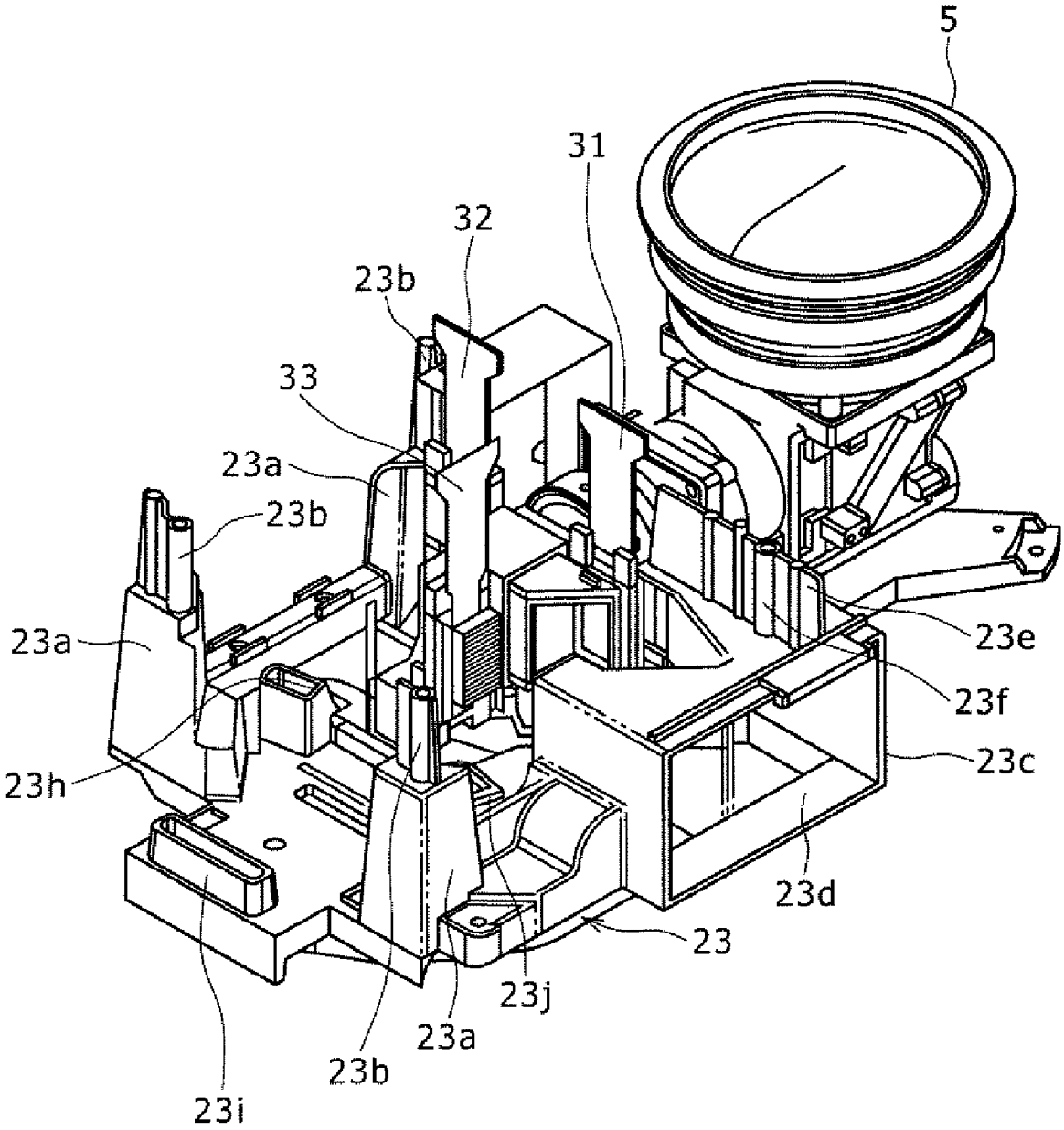
FIG. 6 is a perspective view showing optical parts mounted, in the condition where the shield sheet metal is removed from the optical unit storing section in the example shown in FIG. 5.

FIG. 6 is a perspective view showing the condition where the shield sheet metal 35 shown in FIG. 5 is removed.

The projection lens 5 is provided at a predetermined position relative to a base block 23 produced by die casting or the like from an aluminum alloy, through a support part provided at a lower portion thereof.

The base block 23 is roughly rectangular in shape as viewed from above, is provided on the right lower side in FIG. 6 with an air cooling fan attaching port **23*d* of a blowing duct 23*c* roughly rectangular in sectional shape, and is provided with stands 23*a* at three corner portions thereof. The base block 23 is provided, on the side opposite to the projection lens 5, with three optical filter attaching guides 23*h*, 23*i* and 23*j* for attaching an optical filter unit 21 shown in FIG. 7**.

As shown in FIG. 6, a shaft **23*f* provided with a screw passing hole is erected on the blowing duct 23*c*, a wall-shaped spacer 23*e* is formed, and a shaft 23*b* provided with a screw passing hole in its upper portion is formed integrally with each of the three stands 23*a***.

A color combination prism is disposed roughly at the center, in FIG. 6, of the base block 23, and three liquid crystal panels and a color-separating dichroic mirror are disposed in the periphery of the color combination prism.

Here, the lower surface, in FIG. 6, of the base block 23 is processed to be a reference surface.

Figure 7:
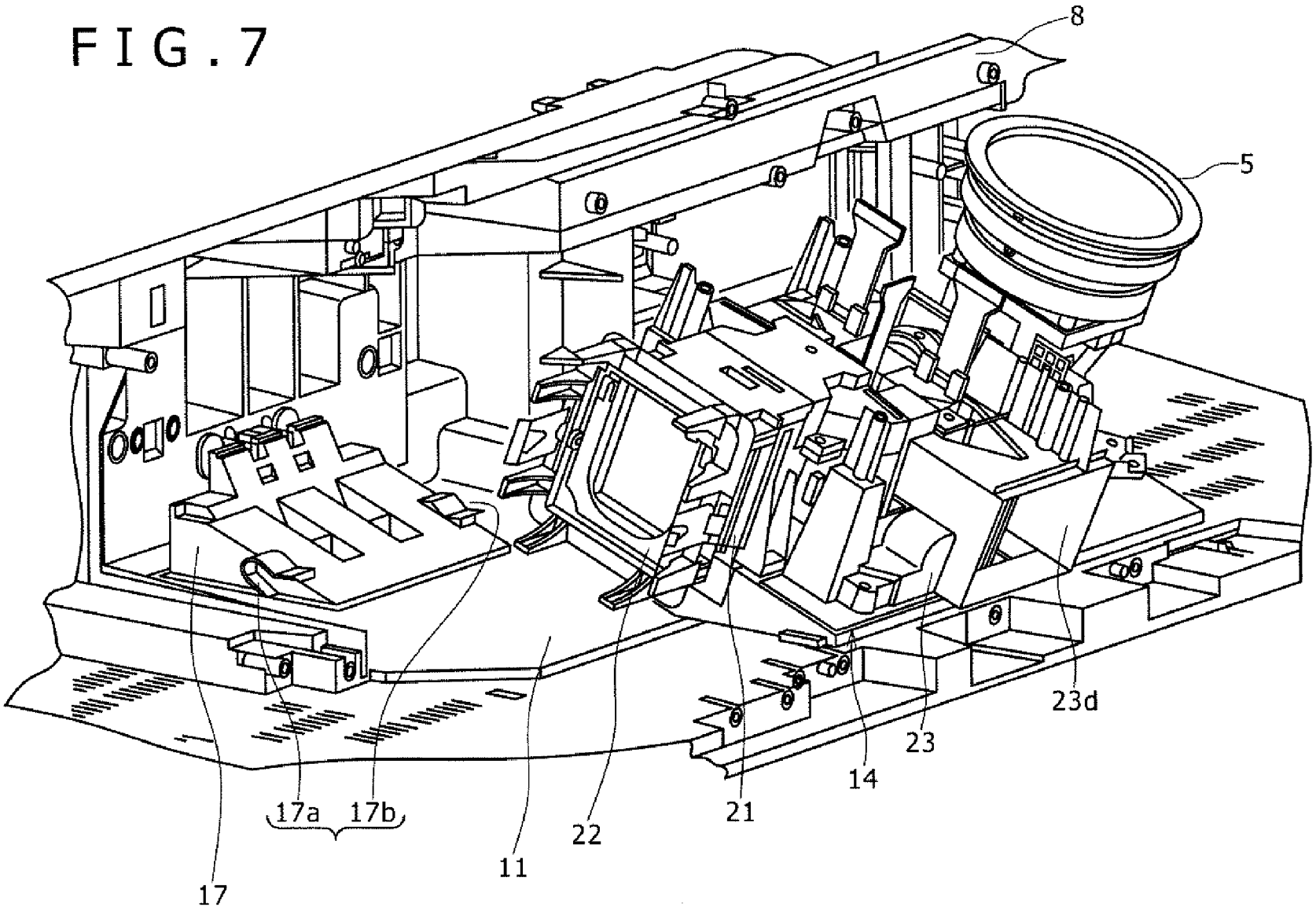
FIG. 7 is an exploded perspective view of the optical unit storing section of a bottom frame, as viewed from the back side of the bottom cabinet in the example shown in FIG. 2.

In the base block 23 configured as above, the color combination prism is disposed roughly at the center, and the three liquid crystal panels and the color-separating dichroic mirror are disposed at predetermined positions. Thereafter, the projection lens 5 is attached, the optical filter unit 21 shown in FIG. 7 is attached by use of the three attaching guides **23*h*, 23*i* and 23*j* shown in FIG. 6 as references, and the optical filter unit 21 is provided with a light source attaching port 22**.

Then, as shown in FIG. 5, the roughly box-shaped shield sheet metal 35 is mounted on and fixed to the top faces of the shafts **23*b* on the three stands 23*a* and the shaft 23*f* on the blowing duct 23*c* of the base block 23 shown in FIG. 6. In this instance, the flexible cables 31, 32 and 33 are drawn out upwards through the three openings 35-1 to 35-3 in the shield sheet metal 35, and are then fixed to the shield sheet metal 35 by the three cable clamps 80, 80, 80 shown in FIG. 5. In this case, the flexible cables 31, 32 and 33 are grounded to the shield sheet metal 35 by conductive elastic bodies 70 (described later) provided for the cable clamps 80**.

Then, as shown in FIG. 4, the liquid crystal panel control substrate 36 is fixed onto the shield sheet metal 35 shown in FIG. 5. In this case, the flexible cables 31, 32 and 33 are drawn out upwards via the openings 36-1 to 36-3 provided in the liquid crystal panel control substrate 36, are fixed and electrically connected to the three FPC connectors 41, 42 and 43, respectively.

Then, as shown in FIG. 3, the covers 51, 52 and 53 are provided at upper portions, whereby an electromagnetic shield is formed around the liquid crystal panel control substrate 36.

Incidentally, the optical unit 4 includes the projection lens 5, the three liquid crystal panels, the color combination prism, the color-separating dichroic mirror, the optical filter unit 21, the light source attaching port 22, the liquid crystal panel control substrate 36, the shield sheet metal 35, and the base block 23 on which these components are mounted.

Now, the cable clamp 80 shown in FIG. 5 provided for the shield sheet metal 35 will be described referring to FIGS. 8A to 8D, FIGS. 9A to 9E, and FIGS. 10A to 10E.

Figure 8A:
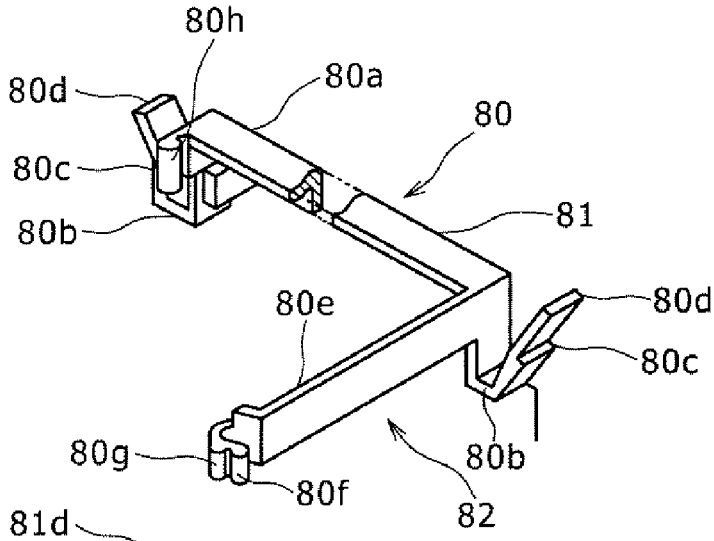

FIG. 8A is a perspective view of the cable clamp 80. The cable clamp 80, produced by molding from a plastic resin, includes two sections, namely, a chassis lock section 81 serving as a fitting section for attachment to the shield sheet metal 35, and a flat clamp section 82 serving as a holding section for firm (chattering-free) fixation of the flexible wiring board.

Figure 8B:
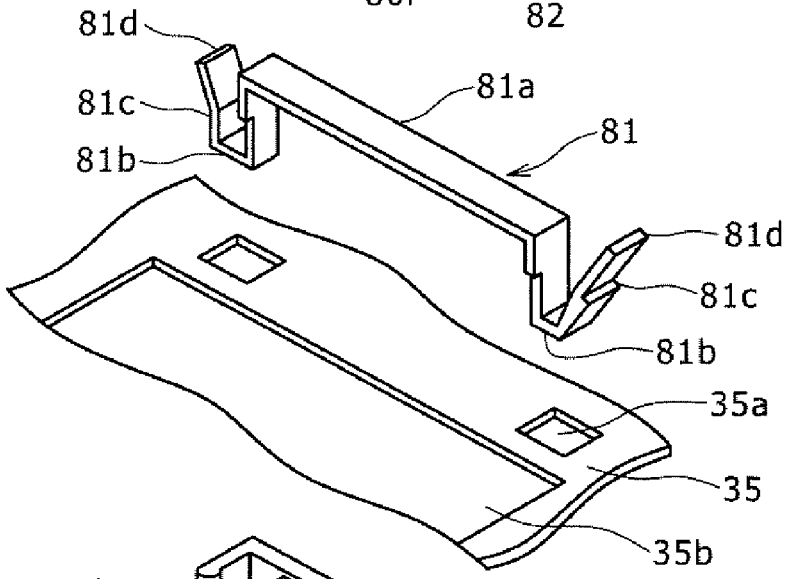

FIG. 8B, which is a perspective view, shows the chassis lock section 81 picked up from the clamp cable 80 shown in FIG. 8A.

The chassis lock section 81 has a configuration in which angular U-shaped hook parts are provided at both ends of a body 81*a* flat rectangular in sectional shape. Each of the hook parts is provided with a passing part 81*b*, a hook pawl 81*c*, and a grip part 81*d*. In the condition where the grip parts 81*d*, 81*d* on both sides are inclined toward the body 81*a*, the passing parts 81*b*, 81*b* and the hook pawls 81*c*, 81*c* are passed through roughly rectangular hook holes 35*a* provided in the shield sheet metal 35. Thereafter, the grip parts 81*d*, 81*d* are released to put the hook holes 35*a*, 35*a* and the hook pawls 81*c*, 81*c* into mutually hooked conditions, whereby the chassis lock section 81 itself is fixed to the shield sheet metal 35.

Figure 8C:
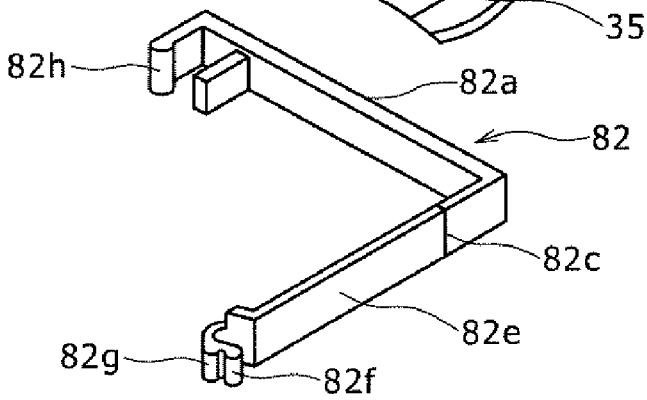
Figure 8D:
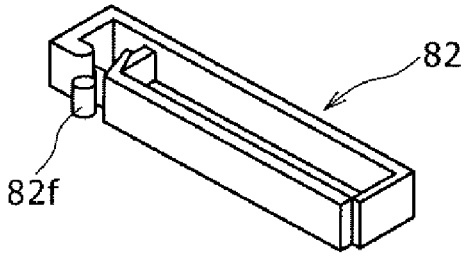

FIGS. 8C and 8D, which are perspective views, show the flat clamp section 82 picked up from the cable clamp 80 shown in FIG. 8A, wherein FIG. 8D shows the condition where the clamp is closed.

The flat clamp section 82 has a structure in which a strip flat rectangular in sectional shape is formed into an L-shaped form, of which one end side is bent to be short and provided with an engaged projected part 82*h* at the tip thereof. A clamp 82*e* which is turnable is formed by providing a cut 82*c* near the bent portion of the L-shaped form so as to permit bending to the other end side, and an engaging pawl 82*g* and a grip part 82*f* are provided at the tip of the clamp 82*e*. Here, symbol 82*a* denotes a body.

As shown in FIG. 8D the clamp 82*e* is bent at the cut 82*c*, and the engaging pawl 82*g* and the engaged projected part 82*h* are engaged with each other, for hooking in the closed condition, so that when the grip part 82*f* in the closed condition shown in FIG. 8D is depressed, the engaging pawl 82*g* can be disengaged from the engaged projected part 82*h* and the flat clamp section 82 can be returned into the condition shown in FIG. 8C.

Specifically, the cable clamp 80 is produced by a method in which the bodies 81*a* and 82*a* of the chassis lock section 81 shown in FIG. 8B and the flat clamp section 82 shown in FIG. 8C are integrally molded so that they are orthogonal to each other, as indicated by a broken section of the body 80*a* shown in FIG. 8A.

Figure 9A:
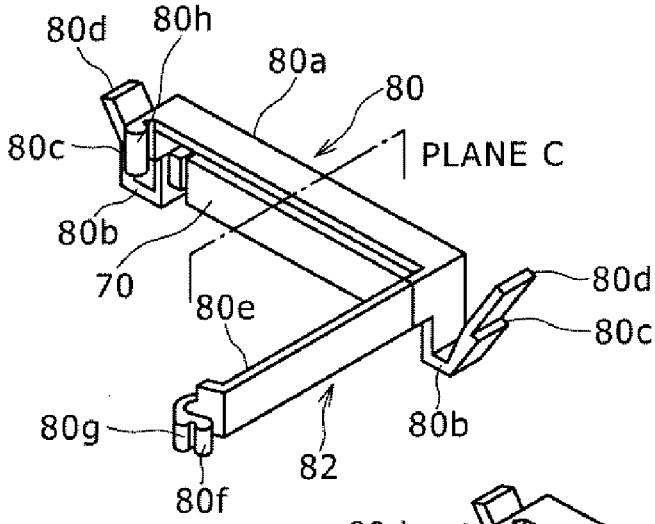
Figure 9B:
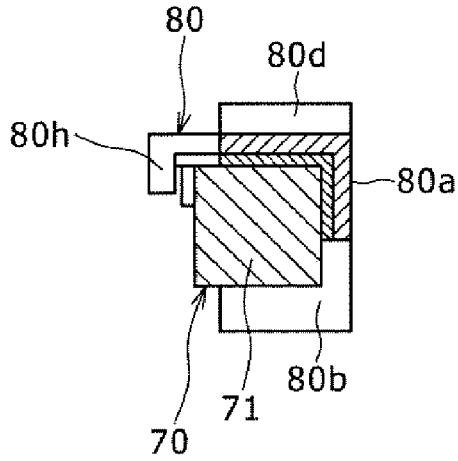

As shown in FIGS. 9A and 9B, in the cable clamp 80 configured as above, a conductive elastic body 70 in which the outer periphery of a rectangular parallelopiped foam 71 is covered with a conductive fabric is adhered to the body 80*a* by use of an adhesive double coated tape or the like.

Figure 9C:
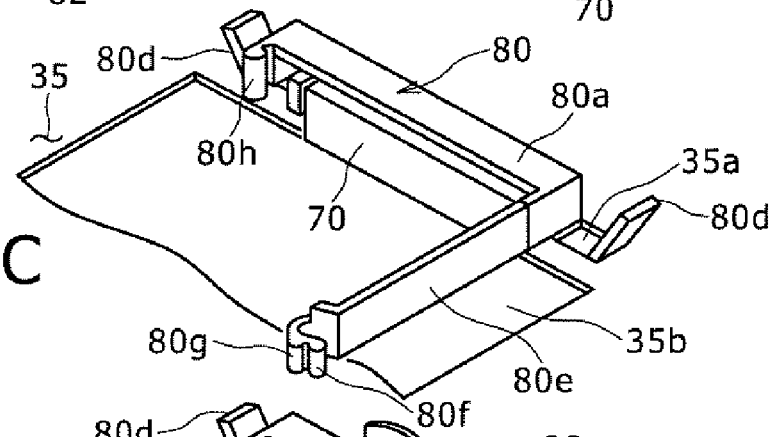

When the cable clamp 80 provided with the conductive elastic body 70 is fixed to the hook holes 35*a* in the shield sheet metal 35, as shown in FIG. 9C, the conductive elastic body 70 is deformed between the body 80*a* of the cable clamp 80 and the shield sheet metal 35, to make close contact with the shield sheet metal 35.

Figure 9D:
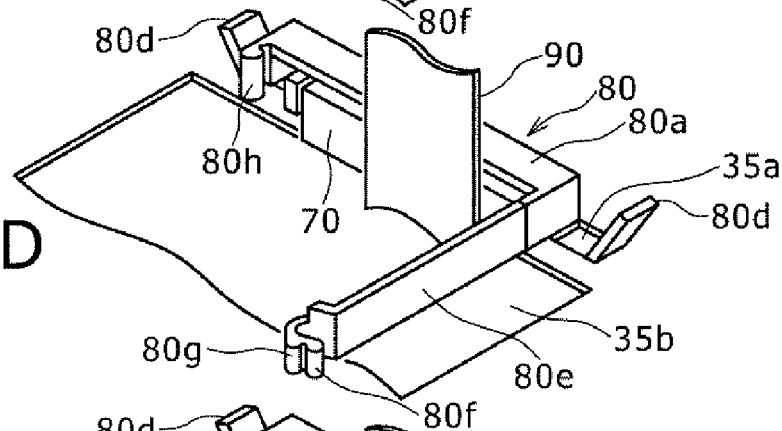
Figure 9E:
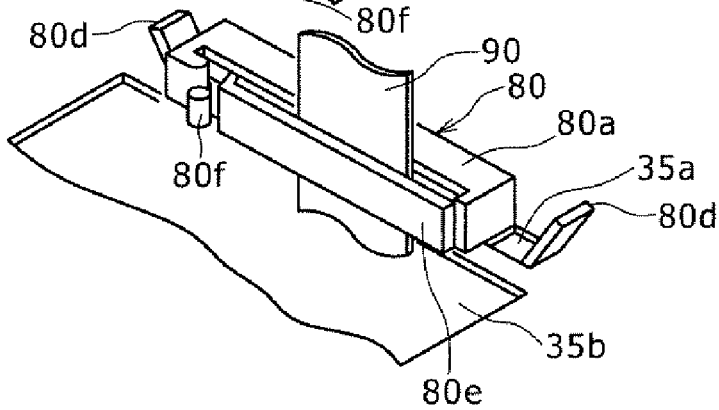

Then, as shown in FIGS. 9D and 9E, the flexible wiring board 90 drawn out through an opening 35*b* in the vicinity of the position of fixation of the cable clamp 80 can be firmly fixed by clamping it between the body 80*a* and the clamp 80*e* through the conductive elastic body 70.

Particularly, in the optical unit 4 in this embodiment, the R flexible cable 31, the G flexible cable 32 and the B flexible cable 33 extended from the liquid crystal panel are used as the flexible wiring boards, as shown in FIGS. 4 to 8. Since high-frequency waves are used in the liquid crystal panel control substrate 36, the grounding metal wirings for connection to the ground line are provided on one-surface side of the cables 31, 32 and 33, as a measure to cope with EMC having electromagnetic non-interference property and durability. The side, on which the grounding metal wiring is formed, of each of the cables 31, 32 and 33 is provided on the back side of the cable shown in FIGS. 9D and 9E, namely, on the side of contact with the conductive elastic body 70, whereby grounding to the shield sheet metal 35 can be achieved.

In the cable clamp 80 configured as above, as shown in FIG. 9B, the upper and lower surfaces of the rectangular parallelopiped conductive elastic body 70 are clamped and fixed between the body 80*a* and the shield sheet metal 35, and the other two surfaces are clamped and fixed between the body 80 and the flexible wiring board 90 on the clamp 80*e* side.

By providing the cable clamp 80 with the conductive elastic body 70 and using such cable clamps in the rear projection display apparatus taken as an example of electronic apparatus, the three flexible cables 31, 32 and 33 extended from the liquid crystal panel of the optical unit 4 and each having the ground wiring pattern on one face side thereof are led out through the openings 35-1 to 35-3 provided in the shield sheet metal 35. Then, the flexible cables 31, 32 and 33 thus led out are firmly fixed and grounded by the cable clamps 80 provided on the shield sheet metal 35. Then, the flexible cables 31, 32 and 33 are led out through the openings 36-1 to 36-3 provided in the liquid crystal panel control substrate 36, and connected to connectors 41, 42 and 43, respectively.

Then, the liquid crystal panel control substrate 36 inside the shield sheet metal 35, with the flexible cables 31, 32 and 33 connected thereto, is covered with the covers 51, 52 and 53, whereby electromagnetic waves generated from the liquid crystal panel control substrate 36 can be prevented from influencing other apparatuses, and the liquid crystal panel control substrate 36 can be prevented from making an erroneous operation due to external electromagnetic waves. Thus, a high EMC performance can be obtained.

In addition, as for the necessity or unnecessity of grounding between the shield sheet metal 35 and the flexible cable, it is possible to easily select the condition according to the situation by providing or not providing the conductive elastic body 70; therefore, it is possible to swiftly perform the grounding on the basis of each apparatus.

Furthermore, the conductive elastic body 70 may be formed in a large size and be fixed so as to overhang relative to the opening 35*b* in the shield sheet metal 35 when the clamp 80*e* of the cable clamp 80 is closed. This makes it possible to firmly fix the flexible cables (see FIG. 10A), without providing bushes, grommets or the like which are ordinarily provided as protective members at wire passing sections such as the openings in the shield sheet metal 35.

Figure 10A:
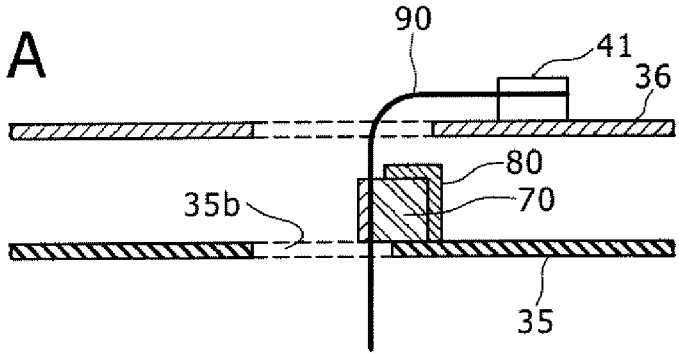
FIGS. 10A to 10E illustrate an example of use of a cable clamp fitted with a conductive elastic body in the example shown in FIGS. 9A to 9D.

FIGS. 10A to 10E show various forms of the cable clamp 80 provided on the shield sheet metal 35, the connector 41 provided on the liquid crystal panel control substrate 36, and the flexible wiring board 90 electrically connected to the connector 41 and firmly fixed to the cable clamp 80. FIG. 10A shows an attached condition in this embodiment as shown in FIG. 9E, and shows an example in which the shield sheet metal 35 and the liquid crystal panel control substrate 36 are set substantially in parallel to each other, and the flexible wiring board 90 is led from the lower side so as to penetrate the shield sheet metal 35 and the liquid crystal panel control substrate 36.

Figure 10B:
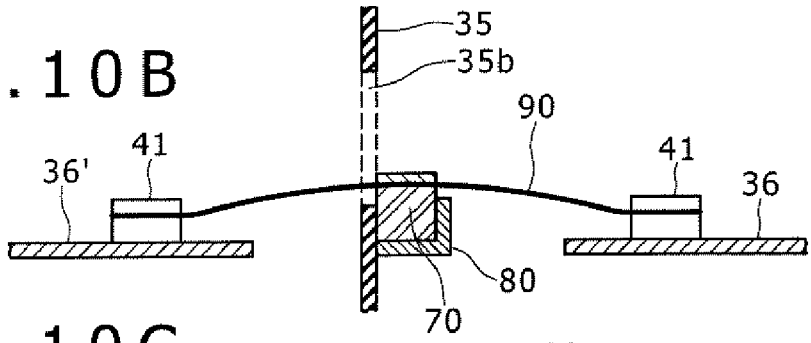
Figure 10C:
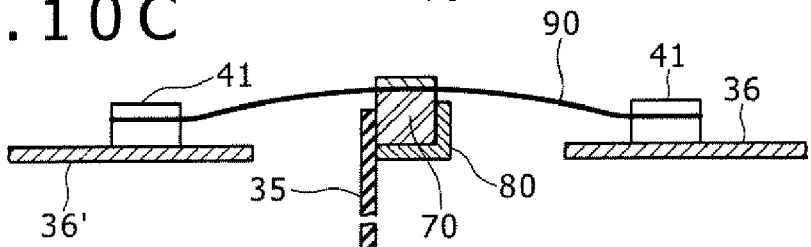

FIG. 10B shows an example in which the shield sheet metal 35 is disposed vertically so as to be orthogonal to the liquid crystal panel control substrate 36 set horizontal, and the flexible wiring board 90 is so provided as to pass through the opening 35*b* provided in the shield sheet metal 35. FIG. 10C shows an example in which the cable clamp 80 as shown in FIG. 10B is provided at the upper end portion of the shield sheet metal 35 disposed vertically.

Figure 10D:
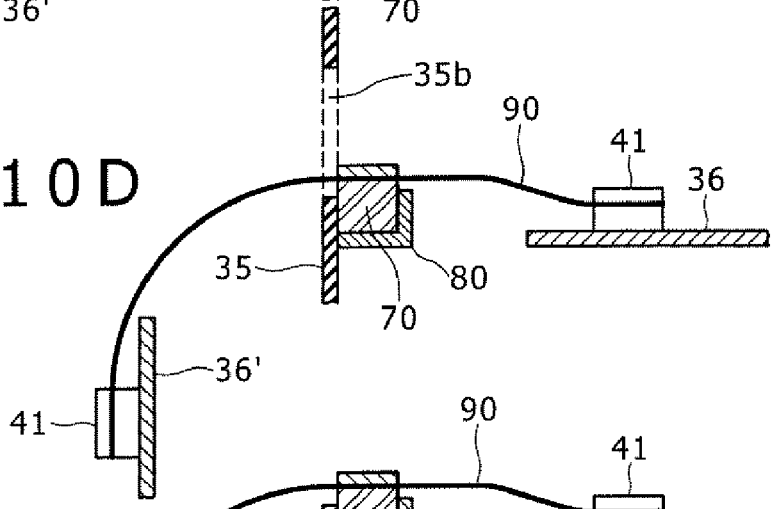

FIG. 10D shows an example in which the liquid crystal panel control substrate has a split structure, a liquid crystal panel control substrate 36' is set orthogonal to a flexible liquid crystal panel control substrate 36, and the flexible wiring board 90 is so provided as to pass through the opening 35*b* provided in the shield sheet metal 35.

Figure 10E:
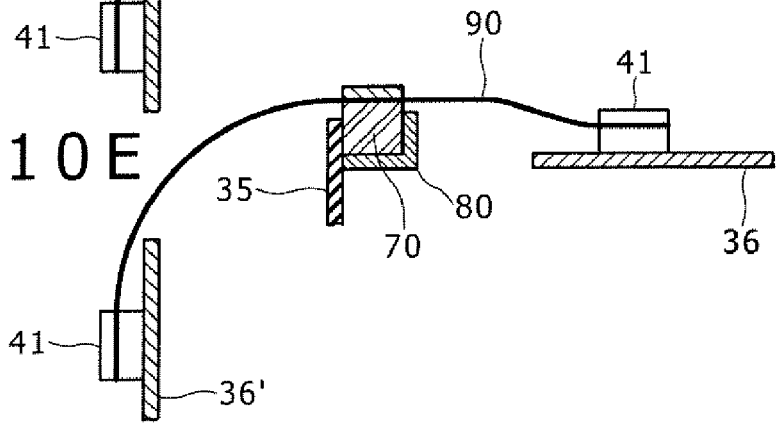

FIG. 10E shows an example in which the cable clamp 80 as shown in FIG. 10D is provided at an upper end portion of the shield sheet metal 35 disposed vertically.

In any one of these examples, the surface, to which the flexible wiring board 90 is fixed, of the conductive elastic body 70 of the cable clamp 80 is provided at a position on the opening 35*b* side or in the upper end space, so that it is fixed without making contact with the shield sheet metal 35, and the flexible wiring board 90 and the shield sheet metal 35 can assuredly be electrically connected to each other.

In addition, since no irrational stress is exerted on the flexible wiring board 90, highly reliable connection can be achieved. Besides, since the presence or absence of conductive connection can be determined by whether or not the conductive elastic body 70 fixed by a pressure sensitive adhesive double coated tape or the like is provided in the cable clamp 80, it is possible to cope with EMC extremely advantageously from the viewpoints of time and cost.

Furthermore, in fixing the flexible wiring board 90 to the cable clamp 80, the flexible wiring board 90 can be provided at such a position as not to make contact with the shield sheet metal 35. Therefore, the flexible wiring board 90 can be protected without providing a wiring protective material, such as grommet, at end faces of the shield sheet metal 35.

Now, a mechanism of adjusting the image on the screen will be described below, referring to FIGS. 3, 7 and 11 to 23.

As above-mentioned, the optical unit 4 is positioned and fixed on the upper surface of the optical unit mount plate 14 through the base block 23, as shown in FIGS. 3 and 7. The optical unit mount plate 14 is so provided as to be engaged with the adjusting plate 17 movable on the base plate 11 on the bottom surface side of the roughly angular U-shaped bottom frame 8 of the bottom cabinet 3.

Now, the optical unit mount plate 14, the adjusting plate 17 and the base plate 11 will be described below.

First, the optical unit mount plate 14 will be described referring to FIGS. 11 to 13.

Figure 11:
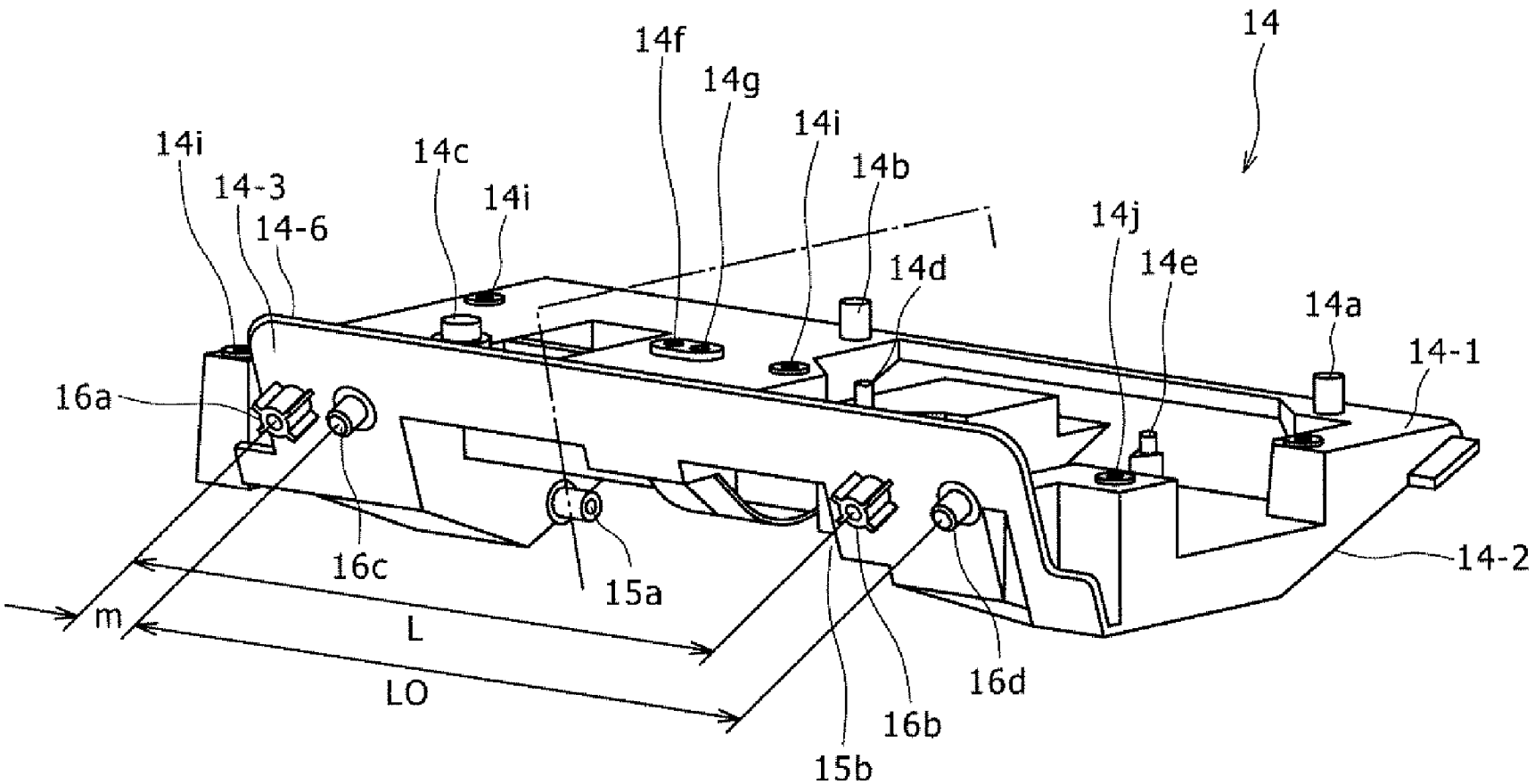
FIG. 11 is a perspective view of an optical unit mount plate alone in the optical unit storing section in the example shown in FIG. 3.
Figure 12:
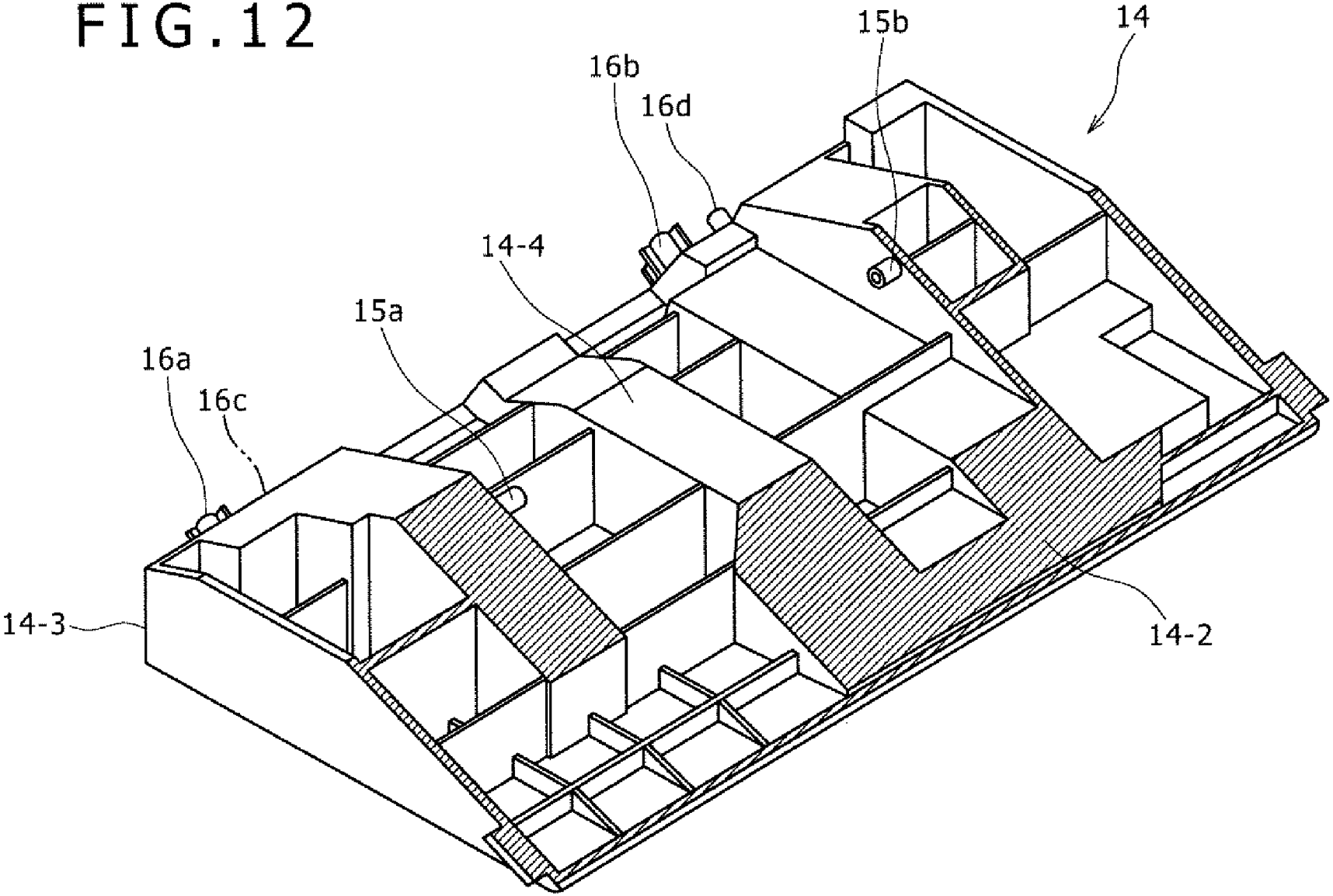
FIG. 12 is a perspective view showing in an inverted state the optical unit mount plate in the example shown in FIG. 11.
Figure 13:
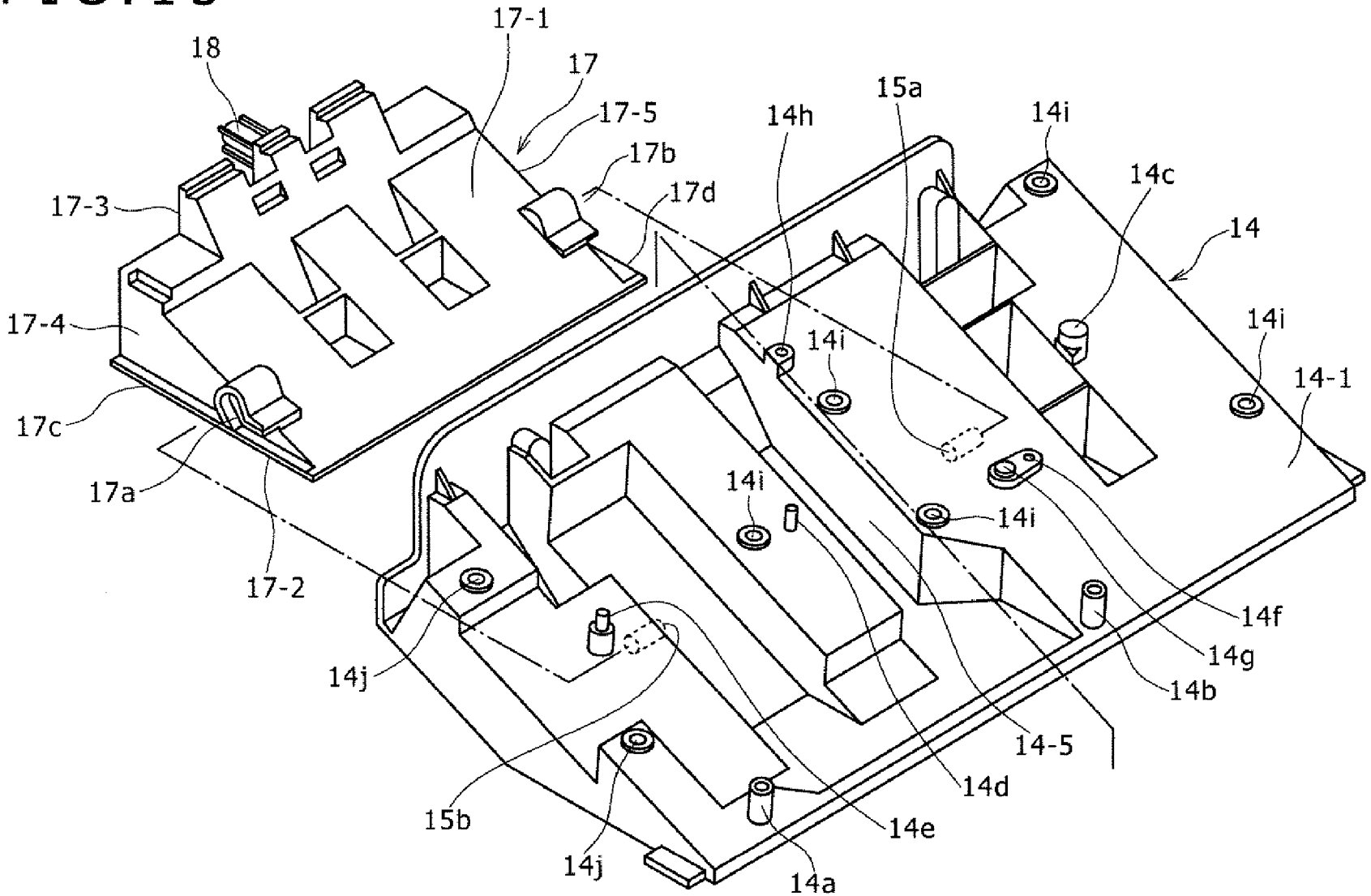
FIG. 13 is a perspective view showing together the optical unit mount plate in the example shown in FIG. 11 and an adjusting plate.

FIGS. 11 to 13 are perspective views of the optical unit mount plate 14, wherein FIG. 11 shows, in a picked-up state, only the optical unit mount plate 14 from substantially the same view point as that of FIG. 3, and FIG. 12 shows the same in an inverted state. FIG. 13 shows both the optical unit mount plate 14 and the adjusting plate 17.

As shown in FIGS. 11 to 13, the optical unit mount plate 14 is formed to have a small material thickness by molding of a plastic resin, is provided with a plurality of recessed parts in its upper surface 14-1 shown in FIG. 11, is provided in its lower surface shown in FIG. 12 with a plurality of projected parts corresponding to the recessed parts in the upper surface 14-1, and is provided with ribs between the projected parts so as to obtain lightweightness and sufficient rigidity.

The optical unit mount plate 14 has its upper surface 14-1 inclined, for example at about 21°, relative to its bottom surface 14-2 shown in FIG. 11. In addition, as shown in FIGS. 11 and 13, the upper surface 14-1 is provided with a plurality of positioning pins and screw passing holes for positioning and fixing the projection lens 5 and the base block 23.

Specifically, the optical unit 4 inclusive of the projection lens 5 is positioned and fixed by three columnar projections 14*a*, 14*b*, 14*h* provided with screw passing holes, a columnar projection 14*c*, large and small two positioning holes 14*f*, 14*g* formed in a roughly oval plateau part, two positioning pins 14*d*, 14*e*, and five screw passing holes 14*i*, of the optical unit mount plate 14 shown in FIG. 13.

Here, the columnar projection 14*c* and the small-diameter hole 14*f* in the roughly oval plateau part position the projection lens 5 at a predetermined position, and the large-diameter hole 14*g* in the roughly oval plateau part and the two positioning pins 14*d*, 14*e* position the base block 23 at a predetermined position. Besides, the five screw passing holes 14*i* and the screw passing holes formed in the three columnar projections 14*a*, 14*b*, 14*h* are used to fix the base block 23 to the optical unit mount plate 14.

In addition, two screw passing holes 14*j* provided in a left end portion, in FIG. 13, of the upper surface 14-1 of the optical unit mount plate 14 are used to fix an optical filter unit 21 to the optical unit mountplate 14.

On the other hand, as indicated by broken lines in FIGS. 12 and 13, the optical unit mount plate 14 is provided on the lower surface side with roughly cylindrical two engaging projections 15*a* and 15*b* oppositely on both sides of a groove 14-5. The engaging projections 15*a* and 15*b* are formed near the bottom surface 14-2, as shown in FIG. 12.

A surface 14-4 composed of the bottom surface of the groove 14-5 shown in FIG. 13 is so formed that it is substantially parallel to the upper surface 14-1 and its height from the upper surface 14-1 is smaller than the height of the engaging projections 15*a*, 15*b*, as shown in FIG. 12.

In addition, a back plate 14-3 of the optical unit mount plate 14 is provided with ribbed projections 16*a* and 16*b* having reinforcing ribs and with roughly hollow cylindrical positioning projected parts 16*c* and 16*d*, as shown in FIG. 11. The center positions of the ribbed projections 16*a*, 16*b* and the positioning projected parts 16*c*, 16*d* are so disposed that they are substantially parallel to an upper end face 14-6 of the back plate 14-3 and that the interval between the ribbed projections 16*a* and 16*b* is L, the interval between the positioning projected parts 16*c* and 16*d* is L0, and the distance between the projection 16*a* and the projected part 16*c* is m.

The intervals and distance here are roughly, for example, L=179 mm, L0=188 mm, and m=17 mm.

Incidentally, relative to the bottom wall 12, the optical unit mount plate 14 is positioned by the projected part 16*c* on the left side and the projected part 16*d* on the right side in FIG. 11, it is fixed by the ribbed projection 16*a* on the left side in FIG. 11, and is fixed at a position after being turned by a predetermined amount by the ribbed projection 16*b* on the right side. In this case, the turning of the optical unit mount plate 14 relative to the base plate 11 is realized by deflection due to the elasticity of the back plate 14-3 molded from a resin.

The adjusting plate 17 is produced to be small in material thickness and roughly wedge-shaped by molding of a plastic resin, and is so formed that its upper surface 17-1 is inclined, for example at about 21°, relative to its lower surface 17-2 as shown in FIG. 13. The upper surface 17-1 shown in the figure is provided with recessed parts, projected parts corresponding to the recessed parts on the upper surface 17-1 side are formed on the lower surface 17-2 side, and ribs are disposed between the projected parts so as to obtain lightweightness and sufficient rigidity.

Side surfaces 17-4 and 17-5 of the adjusting plate 17 are provided at their bottom ends with thin plate-like projections 17*c*, 17*d*, and are provided with engaging grooves 17*a*, 17*b*. The center lines of the engaging grooves 17*a*, 17*b* are set at, for example, about 30° against the lower surface 17-2, the inclination angle being larger than the inclination angle of the upper surface 17-1. The projections 17*c*, 17*d* are so formed that the engaging projections 15*a*, 15*b* of the optical unit mount plate 14 can be smoothly guided at the time of engagement of the adjusting plate 17 with the optical unit mount plate 14. Here, the thickness of the projections 17*c*, 17*d* is about 1 mm.

Besides, as shown in FIG. 13, the back surface 17-3 of the adjusting plate 17 is formed to be substantially orthogonal to the lower surface 17-2, and a ribbed projection 18 having reinforcing ribs is erected on an upper portion thereof.

In addition, the adjusting plate 17 is provided with guide projections (not shown) on its lower surface 17-2.

Figure 14:
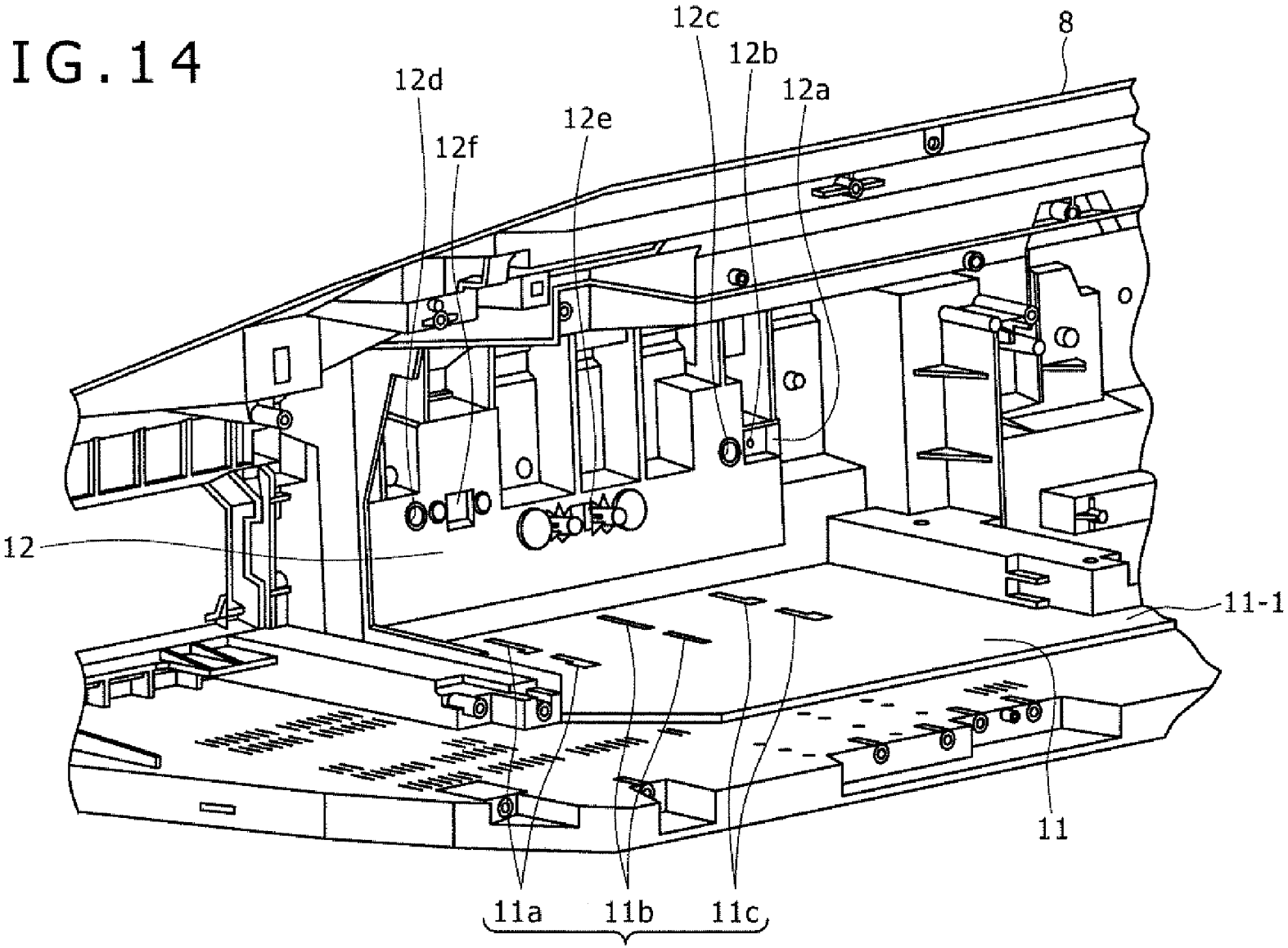
FIG. 14 is a perspective view showing the bottom frame in the example shown in FIG. 7, in the condition where the optical unit storing section is removed.

As shown in FIG. 14, the base plate 11 is the bottom surface of the zone where the adjusting plate 17 is incorporated, namely, the zone where the optical unit 4 is mounted through the optical unit mount plate 14 and the adjusting plate 17, of the bottom frame 8 produced in a thin-walled shape by molding of a plastic resin.

Besides, the bottom wall 12 constituting a wall surface at a part of the bottom frame 8 is formed to be orthogonal to the upper surface 11-1 of the base plate 11 in this zone.

Figure 15A:
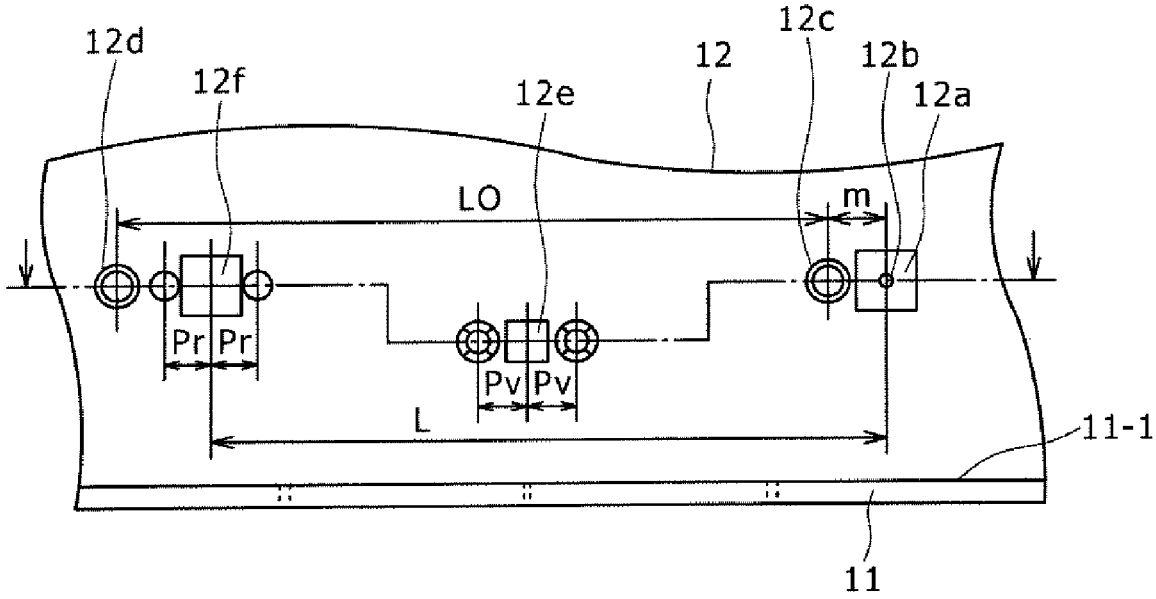
Figure 15B:
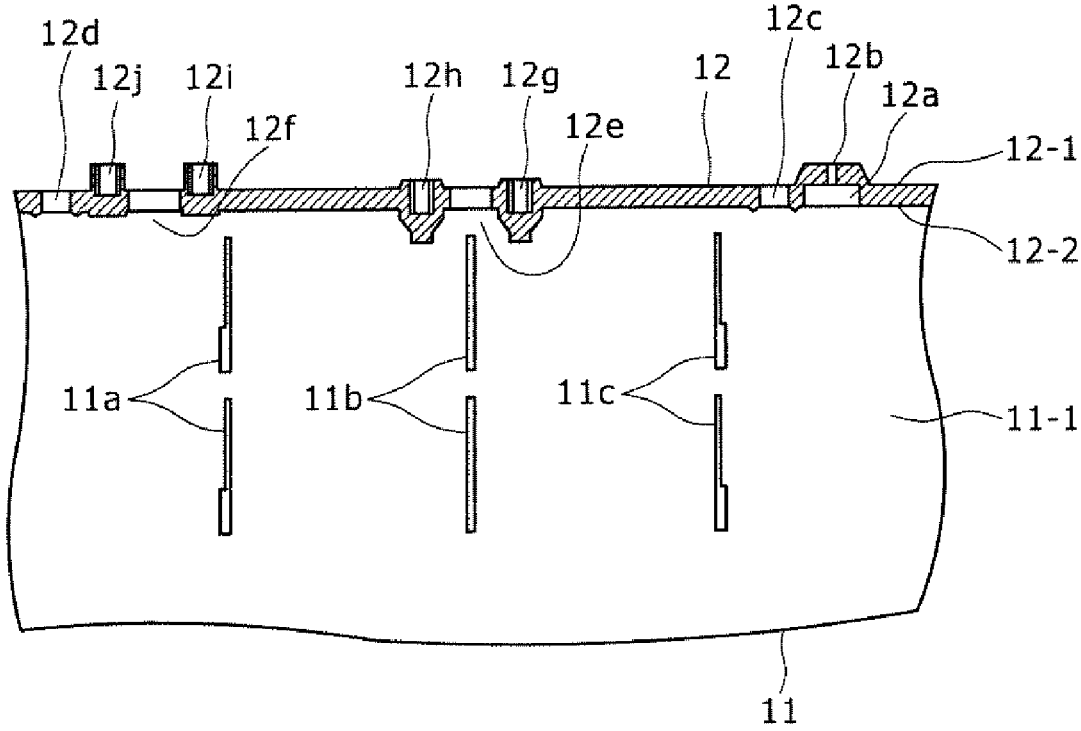

The base plate 11 and the bottom wall 12 in the zone where the optical unit 4 is mounted are schematically shown in FIGS. 15A and 15B. Incidentally, FIG. 15B is a plan view of a section indicated by dot-dash line of the bottom wall 12 shown in FIG. 15A, as viewed along the arrows.

The upper surface 11-1 of the base plate 11 is provided with three pairs of guide slits 11*a*, 11*b* and 11*c* differing in shape, in such a manner that their center lines are orthogonal to the bottom wall 12. The guide slits 11*a*, 11*b* and 11*c* are engaged with the guide projections (not shown) formed on the lower surface 17-2 of the adjusting plate 17 so that the adjusting plate 17 can be slid on the base plate 11 within a predetermined moving range, without disengagement (see FIG. 7).

On the other hand, as shown in FIGS. 14, 15A and 15B, the bottom wall 12 is provided with an opening 12*e* and two screw holes 12*g* and 12*h* so that their centers are at the same height from the upper surface 11-1 of the base plate 11, and the bottom wall 12 is provided with a recessed part 12*a* having a screw passing hole 12*b*, an opening 12*f*, two positioning holes 12*c* and 12*d*, and two screw holes 12*i* and 12*j* so that their centers are at the same height.

Besides, the centers of the recessed part 12*a* having the screw passing hole 12*b*, the opening 12*f*, the two positioning holes 12*c* and 12*d*, and the two screw holes 12*i* and 12*j* are set closer to the upper surface 12-1 of the base plate 11 than the centers of the opening 12*e* and the two screw holes 12*g* and 12*h*.

The opening 12*e* is formed in a roughly rectangular shape so sized that the ribbed projection 18 provided on the back surface 17-3 of the adjusting plate 17 can pass therethrough with a margin. In addition, the screw holes 12*g* and 12*h* are provided with large projections on the back surface 12-2 side thereof, and with ribs for reinforcing the projections, so as to ensure that the portions where these holes are formed would not project largely from the front surface 12-1 of the bottom wall 12.

The center-to-center pitches between the screw hole 12*g* and the opening 12*e* and between the opening 12*e* and the screw pitch 12*h* are set to be equal to the pitch Pv shown in FIG. 17E of screw passing holes 24*c* to 24*g* in the V adjusting piece 24 (described later).

Besides, as shown in FIG. 15A, the center-to-center distance between the screw passing hole 12*b* provided in the recessed part 12*a* and the opening 12*f* is L, the center-to-center interval between the positioning holes 12*c* and 12*d* is L0, and the center-to-center distance between the screw passing hole 12*b* and the positioning hole 12*c* is m.

The recessed part 12*a* is formed in a rectangular recessed shape by projecting a part of the bottom wall 12 from the back surface 12-2 side to the front surface 12-1 side, is so sized as to be able to accommodate a tip portion of the ribbed projection 16 of the optical unit mount plate 14 shown in FIG. 11, and is provided with the screw passing hole 12*b* substantially in the center thereof.

The opening 12*f* is formed in a roughly rectangular shape so sized that the ribbed projection 16*b* provided on the back plate 14-3 of the optical unit mount plate 14 shown in FIG. 11 can pass therethrough with a margin.

The positioning holes 12*c* and 12*d* are round holes formed in the bottom wall 12, and are so formed that the positioning projected parts 16*c* and 16*d* of the optical unit mount plate 14 are engaged respectively with the positioning holes 12*c* and 12*d*.

Namely, the ribbed projections 16*a* and 16*b* of the back plate 14-3 of the optical unit mount plate 14 shown in FIG. 11 correspond to the recessed part 12*a* and the opening 12*f*, whereas the positioning projected parts 16*c* and 16*d* are engaged with the two positioning holes 12*c* and 12*d*.

In addition, the screw holes 12*i* and 12*j* are so formed that the portions where they are formed are projected to the front surface 12-1 side of the bottom wall 11. Besides, the center-to-center pitches between the screw hole 12*i* and the opening 12*f* and between the opening 12*f* and the screw hole 12*j* are set equal to the pitch Pr shown in FIG. 22C of screw passing holes 27*c* to 27*g* in the R adjusting piece 27 (described later).

Figure 16:
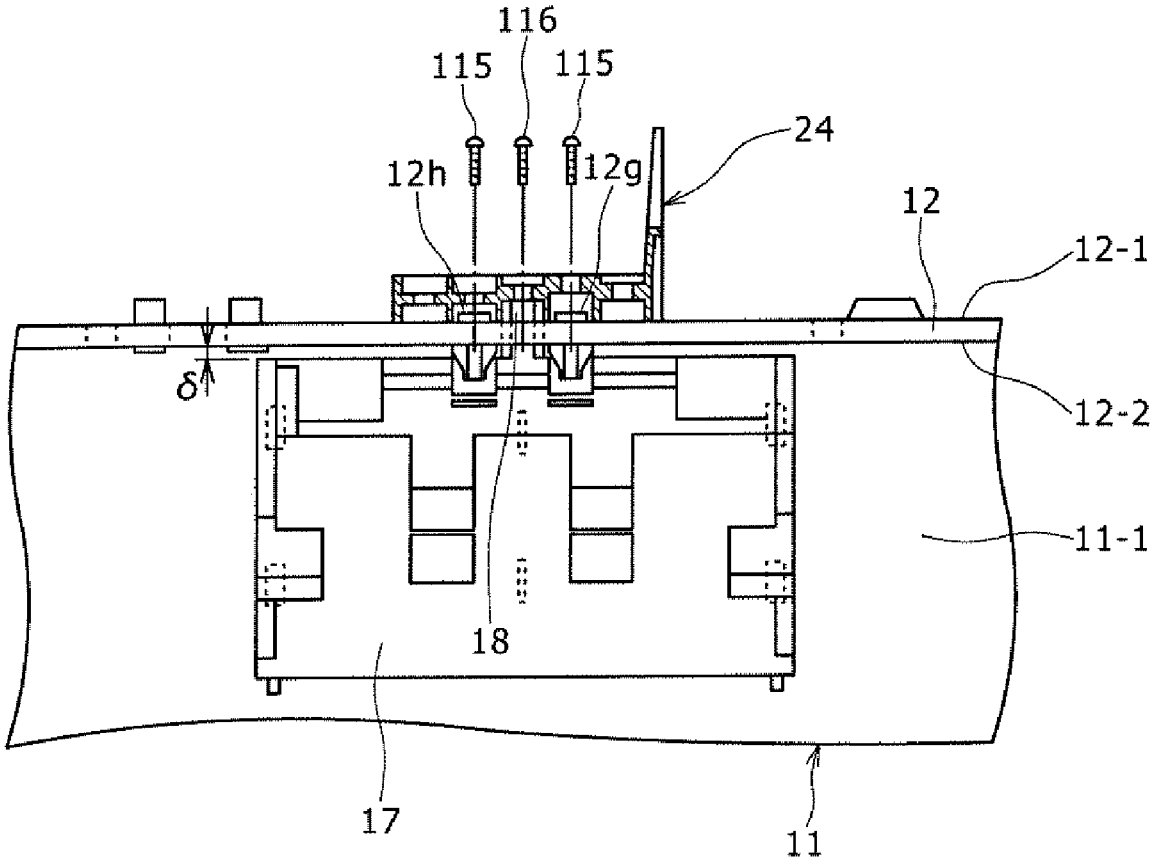
FIG. 16 is a plan view showing the condition where the adjusting plate is mounted to the base plate and the bottom wall in the example shown in FIGS. 15A and 15B.

FIG. 16 is a plan view showing the condition where the adjusting plate 17 is mounted on the base plate 11 so that the guide projections (not shown) provided on the lower surface thereof are engaged with the guide slits 11*a*, 11*b* and 11*c* in the base plate 11 shown in FIG. 15 and then the adjusting plate 17 is slid toward the side of the bottom wall 12. In this instance, the ribbed projection 18 on the back surface 17-3 of the adjusting plate 17 is passed through the opening 12*e* in the bottom wall 12 from the back surface 12-2 side, and its tip portion is projected to and exposed on the side of the front surface 12-1.

In the rear projection display apparatus in this embodiment, the size of the tip portion projected to the side of the front surface 12-1 is adjusted by the V adjusting piece 24.

Figure 17A:
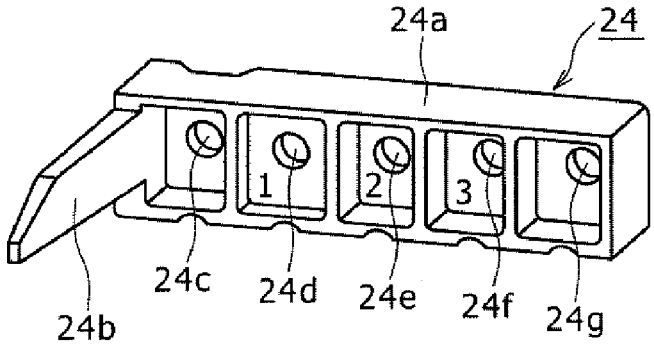
Figure 17B:
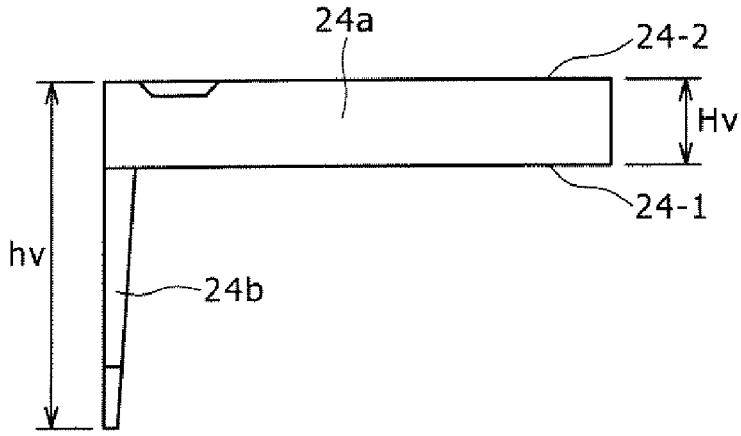
Figure 17C:
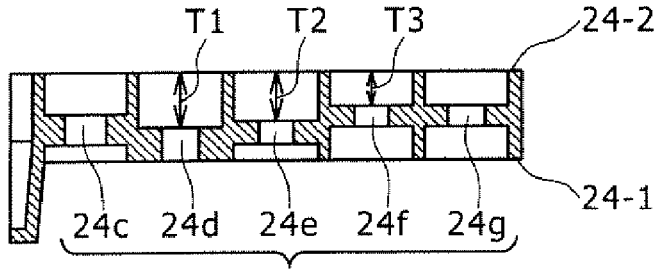
Figure 17D:
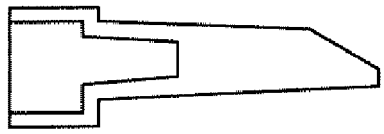
Figure 17E:
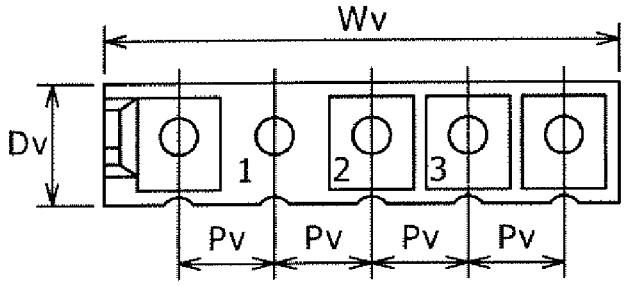
Figure 17F:
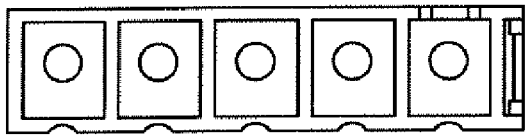

FIGS. 17A to 17F illustrate the shape of the V adjusting piece 24 shown in FIG. 2, wherein FIG. 17A is a perspective view, FIG. 17B is a plan view, FIG. 17C is a sectional view showing the V adjusting piece 24 by removing a part of FIG. 17B, FIG. 17D is a left side view, FIG. 17E is a front view, and FIG. 17F is a back elevation.

The V adjusting piece 24 is produced, for example, by injection molding from a hard plastic resin, and includes a body 24*a* provided with a plurality of screw passing holes, and a lever 24*b* erected on the body 24*a*, as shown in FIG. 17A. The body 24*a* is formed in a small-height tubular shape rectangular in section, the inside of the tubular shape is portioned into five zones by four partition plates, and a roughly rectangular bottom plate provided with the screw passing hole is integrally formed in each of the partitioned zones. The five screw passing holes 24*c*, 24*d*, 24*e*, 24*f* and 24*g* have roughly equal diameters, and their centers are aligned on a straight line at a fixed pitch (Pv).

As shown in FIG. 17A, for example, "No. 1" is made to correspond to the second screw passing hole 24*d* from the left, "No. 2" is made to correspond to the third screw passing hole 24*e*, and "No. 3", is made to correspond to the fourth screw passing hole 24*f*. Namely, the hole 24*d* with a depth T1 from the bottom surface 24-2 to the bottom plate shown in FIG. 17C is made to correspond to "No. 1", the hole 24*e* with a depth T2 is made to correspond to "No. 2", and the hole 24*f* with a depth T3 is made to correspond to "No. 3".

Roughly referring to the size of the V adjusting piece 24 in this embodiment, the height Hv of the body 24*a* shown in FIG. 17B is Hv=11 mm, the height hv to the tip of the lever 24*b* is hv=48 mm, the depth T1 shown in FIG. 17C is T1=9.4 mm, T2 is T2=6.9 mm, T3 is T3=4.4 mm, the width Wv of the body 24*a* shown in FIG. 17E is Wv=70 mm, the depth Dv is Dv=17 mm, the pitch Pv of the holes is Pv=13 mm, and the diameter of the holes is 4.5 mm.

The attachment of the adjusting plate 17, using the V adjusting piece 24 formed as above, to the base plate 11 and the bottom wall 12 will be described. Here, description will be made of an example in which the ribbed projection 18 of the V adjusting piece 24 is fixed to the hole of "No. 2", at the center of the V adjusting piece 24.

First, as shown in FIG. 16, the ribbed projection 18 on the back surface 17-3 of the adjusting plate 17 is passed through the opening 12*e* shown in FIG. 15B, the V adjusting piece 24 is attached thereto from the side of the front surface 12-1, and fixing screws 115, 115 are screw-engaged into the screw holes 12*g* and 12*h* on both sides of the opening 12*e*, whereby the V adjusting piece 24 is fixed to the bottom wall 12.

Next, a fixing screw 116 is screw-engaged into a screw hole in a tip portion of the ribbed projection 18 of the adjusting plate 17 projecting from the opening 12*e* to the side of the front surface 12-1, thereby fixing the adjusting plate 17 to the V adjusting piece 24.

As a result, the gap δ shown in FIG. 16 between the bottom wall 12 and the back surface 17-3 of the adjusting plate 17 corresponds to the depth T2 of "No. 2" in the V adjusting piece 24.

Specifically, since T1>T2>T3 in V the adjusting piece 24 in this embodiment as above-mentioned, in the case of the depth T1 of "No. 1" the tip portion of the ribbed projection 18 of the adjusting plate 17 protrudes most largely from the opening 12*e*, so that the gap δ is the smallest in the three cases. On the other hand, in the case of the depth T3 of "No. 3", the tip portion of the ribbed projection 18 of the adjusting plate 17 protrudes most little from the opening 12*e*, so that the gap δ is the largest in fixation.

Then, the tip surface of the ribbed projection 18 of the adjusting plate 17 is positioned relative to the front surface 12-1 of the bottom wall 12 so as to obtain the depth corresponding to one of Nos. 1 to 3.

Now, a mechanism of adjusting the image projected on the screen 7 in the vertical direction will be described below, referring to FIGS. 1 and 18 to 20.

Specifically, the optical unit mount plate 14 is fixed to the bottom wall 12, and, in this condition, the relative position of the adjusting plate 17 disposed on the lower side of the optical unit mount plate 14 from the bottom wall 12 is varied to change the above-mentioned gap δ. The change in the inclination angle of the upper surface 14-1 of the optical unit mount plate 14 attendant on the positional change will be described, referring to FIGS. 18A to 18E.

FIGS. 18A to 18E illustrate the manner in which engaging grooves 17*a* and 17*b* come, from the left side in the figures, closer to and are engaged with the engaging projections 15*a* and 15*b* provided on the lower side of the optical unit mount plate 14 shown in FIG. 11, on the base plate 11 (see FIG. 13).

Here, the optical unit mount plate 14 is fixed to the bottom wall 12, and the adjusting plate 17 is slidably engaged through guide projections 17*f* provided on the lower surface 17-2 thereof and the guide slits 11*a*, 11*b*, 11*c* in the base plate 11. Specifically, since the adjusting plate 17 is moved on the base plate 11, the center-to-center distance q in the height direction between the centers of the positioning projected parts 16*c*, 16*d* of the back plate 14-3 shown in FIG. 11 of the optical unit mount plate 14 and the center of the ribbed projection 18 of the adjusting plate 17 is constant.

Figure 18A:
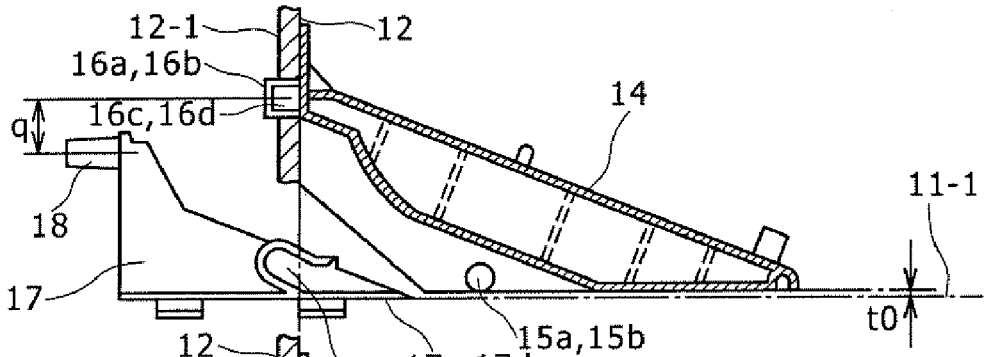
FIGS. 18A to 18E illustrate adjustment of the optical axis of an optical unit by the adjusting plate, respectively showing the conditions of the adjusting plate in relation to the optical unit mount plate fixed to the bottom wall, wherein the adjust place is completely separated in FIG. 18A, the adjusting plate has just been engaged in FIG. 18B, and the adjusting plate is engaged and the optical unit mount plate is inclined in FIGS. 18C to 18E.
Figure 18B:
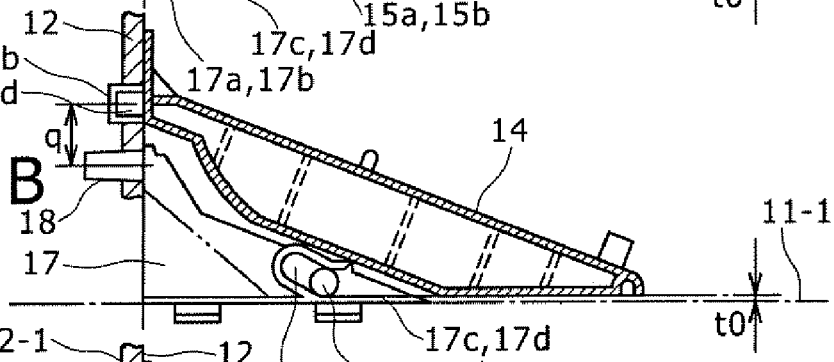

In addition the bottom surface 14-2 of the optical unit mount plate 14 is fixed to the bottom wall 12 so that the gap t0 between itself and the base plate 11 is t0≈1 mm, as shown in FIG. 18A which shows the condition where the optical unit mount plate 14 is not making contact with the adjusting plate 17.

Figure 18C:
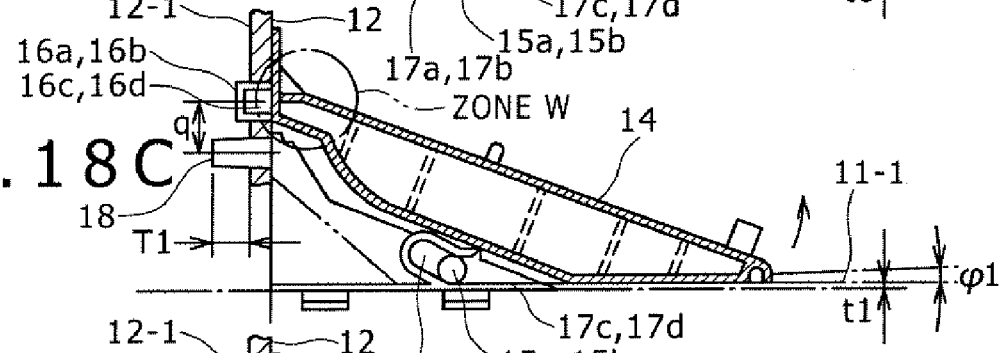
Figure 18D:
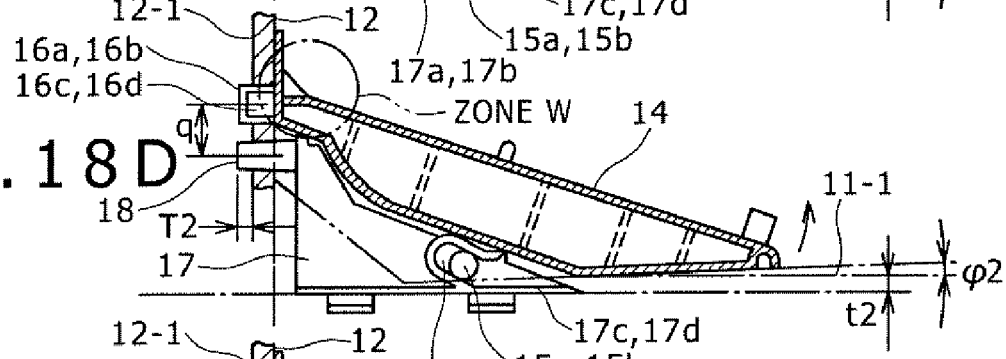
Figure 18E:
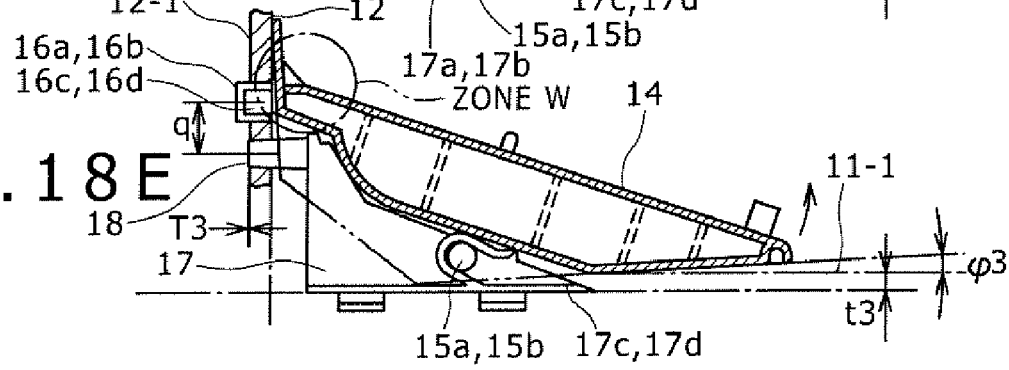

FIG. 18E shows the condition where the adjusting plate 17 is moved toward the right side in the figure until the back plate 14-3 of the optical unit mount plate 14 and the back surface 17-3 of the adjusting plate 17 become flush with each other and where its engaging grooves 17*a*, 17*b* are engaged with the engaging projections 15*a*, 15*b* of the optical unit mount plate 14.

In this instance, the engaging projections 15*a* and 15*b* slide on the projections 17*c* and 17*d* without resistance and are located at the positions of entrances of inclined portions of the engaging grooves 17*a* and 17*b*, since the gap t0 is t0=1 mm and the thickness of the projections 17*c* and 17*d* of the adjusting plate 17 is 1 mm.

In other words, the gap between the bottom surface 14-2 of the optical unit mount plate 14 and the base plate 11 is substantially kept at the value of t0, so that there is no influence of the movement of the adjusting plate 17.

FIG. 18C shows the condition where the ribbed projection 18 of the adjusting plate 17 is disposed at such a position as to project by a size of T1 from the surface of the bottom wall 12.

In this case, the engaging projections 15*a* and 15*b* of the optical unit mount plate 14 enter into the inclined portions of the engaging grooves 17*a* and 17*b* of the adjusting plate 17. Then, the optical unit mount plate 14 is slightly turned counterclockwise (in the direction of arrow in the figure), with a zone W near the ribbed projections 16*a* and 16*b* shown in FIG. 11 as a fixed end, resulting in that the gap between itself and the base plate 11 is t1 (t1>t0) and the angle between itself and the base plate 11 is ϕ1.

FIG. 18D shows the condition where the ribbed projection 18 of the adjusting plate 17 is disposed at such a position as to protrude by a size of T2 from the surface of the bottom wall 12.

In this case, the engaging projections 15*a* and 15*b* of the optical unit mount plate 14 enter to the centers of the inclined portions of the engaging grooves 17*a* and 17*b* of the adjusting plate 17. Then, the optical unit mount plate 14 is further turned counterclockwise (in the direction of arrow in the figure), with the zone W near the ribbed projections 16*a* and 16*b* thereof as a fixed end, resulting in that the gap between itself and the base plate 11 is t2 (t2>t1) and the angle between itself and the base plate 11 is ϕ2.

FIG. 18E shows the condition where the ribbed projection 18 of the adjusting plate 17 is disposed at such a position as to project by a size of T3 from the surface of the bottom wall 12.

In this case, the engaging projections 15*a* and 15*b* of the optical unit mount plate 14 enter substantially to the upper ends of the inclined portions of the engaging grooves 17*a* and 17*b* of the adjusting plate 17. Then, the optical unit mount plate 14 is further turned counterclockwise (in the direction of arrow in the figure), with the zone W near the ribbed projections 16*a* and 16*b* as a fixed end, resulting in that the gap between itself and the base plate 11 is t3 (t3>t2) and the angle between itself and the base plate 11 is ϕ3.

In this manner, by adjusting the size by which the ribbed projection 18 of the adjusting plate 17 protrudes from the surface 12-1 of the bottom wall 12, the optical unit mount plate 14 is turned, with the zone W near the ribbed projections 16*a* and 16*b* and the positioning projected parts 16*c* and 16*d* thereof as a fixed end, whereby the gap between itself and the base plate 11 as well as the angle between itself and the base plate 11 can be adjusted.

Specifically, since the bottom cabinet 3 inclusive of the bottom wall 12 and the optical unit mount plate 14 are formed in plate-like shapes by molding a plastic resin, the bottom wall 12 and the back plate 14-3 of the optical unit mount plate 14 have elasticity relative to deformation. Besides, when a lifting-up force is exerted on the optical unit mount late 14 by a positional change of the adjusting plate 17, the bottom wall 12 and the optical unit mount plate 14 are slightly deformed so that the tip side of the optical unit mount plate 14 is turned in the manner of being lifted up.

Therefore, the optical axis of the projection lens 5 of the optical unit 4 mounted on the optical unit mount plate 14 can be adjusted in a plane in which the bottom wall 12 and the base plate 11 intersect orthogonally, whereby the image projected on the screen 7 shown in FIG. 1 can be adjusted in the vertical direction.

Now, a method in which the size of protrusion of the ribbed projection 18 of the adjusting plate 17 from the surface 12-1 of the bottom wall 12 is adjusted by the V adjusting piece 24 shown in FIG. 2 will be described below, referring to FIGS. 2 and 17 to 20.

Figure 19:
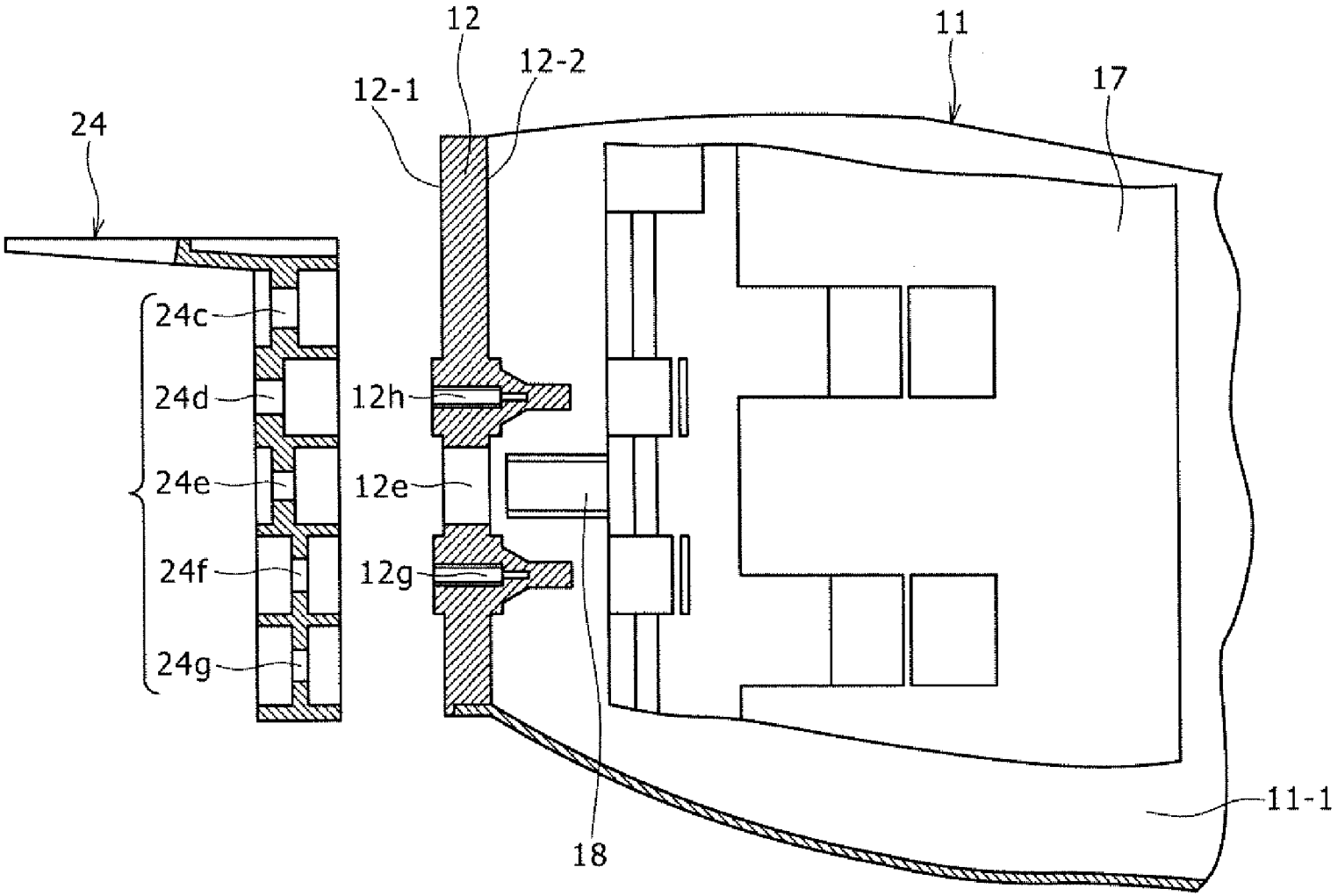
FIG. 19 is a plan view illustrating the setting of the position of the adjusting plate mounted to the base plate and the bottom wall in the example shown in FIG. 15.

FIG. 19 is a plan view showing, with only an essential part broken, the condition immediately before the adjusting plate 17 mounted on the base plate 11 is moved to a predetermined position of the bottom wall 12 and before the V adjusting piece 24 is fixed.

In the predetermined position, the ribbed projection 18 on the back surface 17-3 of the adjusting plate 17 can be passed through the opening 12*e* in the bottom wall 12. Then, fixing screws are passed through three of the holes 24*c* to 24*g* in the V adjusting piece 24 shown in FIG. 17, in such a manner as to correspond to the screw hole 12*g*, the opening 12*e* and the screw hole 12*h* in the bottom wall 12, and fixation is conducted.

Figure 20A:
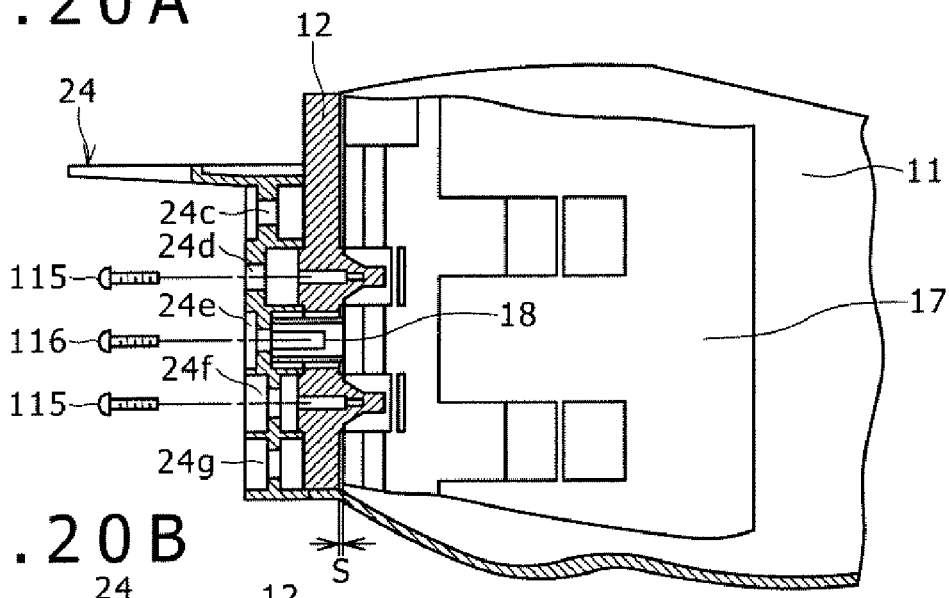
FIGS. 20A to 20C are plan views illustrating the setting of the position of the adjusting plate in the example shown in FIG. 19 by the V adjusting piece, wherein the fixed conditions at screw passing holes of "No. 2", "No. 3" and "No. 1" shown in FIG. 17E are respectively shown in FIG. 20A, FIG. 20B and FIG. 20C.
Figure 20B:
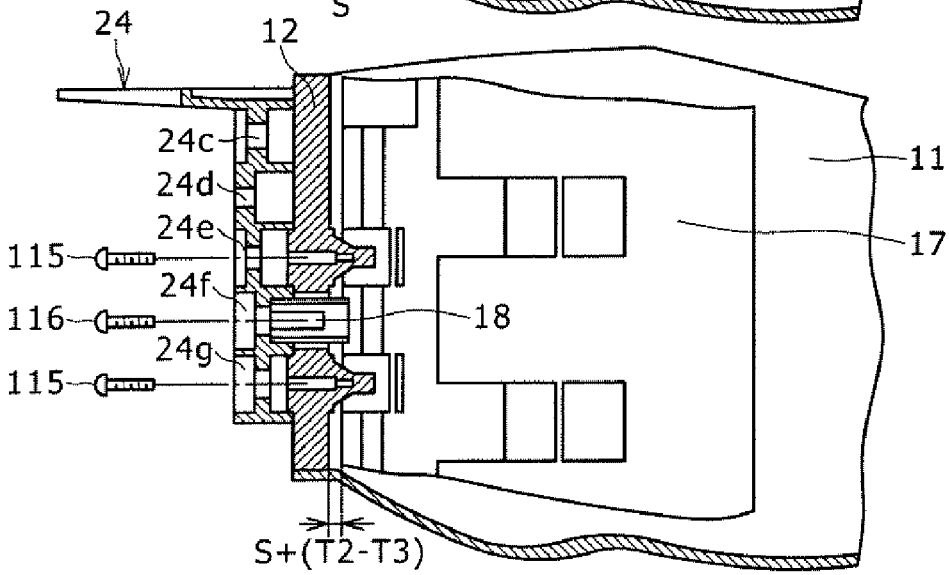
Figure 20C:
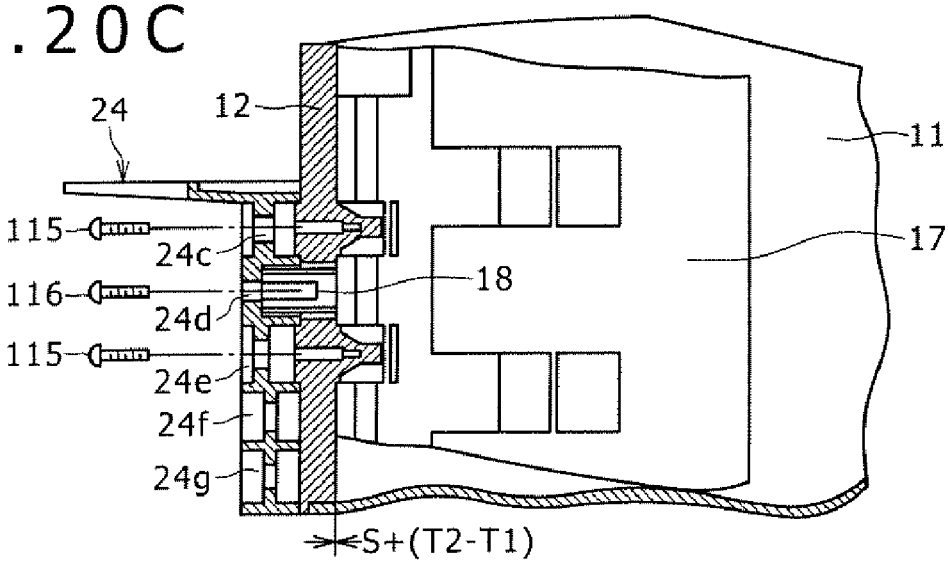

FIGS. 20A to 20C show the adjustment of the size of protrusion of the ribbed projection 18 of the adjusting plate 17 from the surface 12-1 of the bottom wall 12 by the V adjusting piece 24 shown in FIG. 17.

FIG. 20A shows the condition where a fixing screw is passed through the screw passing hole 24*e* corresponding to "No. 2" in the V adjusting piece 24 and screw-engaged and fixed into the screw hole in the ribbed projection 18 of the adjusting plate 17, and the V adjusting piece 24 is fixed to the bottom wall 12 by use of the holes 24*d* and 24*f* on both sides of the screw passing hole 24 and the screw holes 12*g* and 12*h* in the bottom wall 12.

In this instance, the gap between the bottom wall 12 and the back surface 17-3 of the adjusting plate 17 is a size s, corresponding to the depth T2 of "No. 2" shown in FIG. 17C.

FIG. 20B shows the condition where the adjusting plate 17 is fixed by use of the screw passing hole 24*f* corresponding to "No. 3" in the V adjusting piece 24, and the V adjusting piece 24 is fixed to the bottom wall 12 by use of the holes 24*e* and 24*g* on both sides of the screw passing hole 24*f* and the screw holes 12*g* and 12*h* in the bottom wall 12.

In this instance, the gap between the bottom wall 12 and the back surface 17-3 of the adjusting plate 17 is a size s+(T2−T3), corresponding to the depth T3 of "No. 3" shown in FIG. 17C.

FIG. 20C shows the condition where the adjusting plate 17 is fixed by use of the screw passing hole 24*d* corresponding to "No. 2" in the V adjusting piece 24, and the V adjusting piece 24 is fixed to the bottom wall 12 by use of the holes 24*c* and 24*e* on both sides of the screw passing hole 24*d* and the screw holes 12*g* and 12*h* in the bottom wall 12.

In this case, the gap between the bottom wall 12 and the back surface 17-3 of the adjusting plate 17 is a size s+(T2−T1), corresponding to the depth T1 of "No. 1" shown in FIG. 17C.

In short, the V adjusting piece 24 is fixed to the ribbed projection 18 correspondingly to one of the hole Nos. 1 to 3, and the V adjusting piece 24 is fixed to the bottom wall 12, whereby the position of the adjusting plate 17 relative to the bottom wall 12 can be changed. Therefore, as shown in FIGS. 18A to 18E, the bottom surface 14-3 of the optical unit mount plate 14 engaged with the adjusting plate 17 can be lifted up and inclined relative to the base plate 11.

Thus, three image adjustment positions can be obtained by a method in which any one of the Nos. 1 to 3 shown in FIGS. 17C and 17E and the corresponding depths T1 to T3 is set to the size of protrusion of the ribbed projection 18 of the adjusting plate 17 by use of the V adjusting piece 24 provided on the front side of the bottom cabinet 3 shown in FIG. 2. Besides, by a method in which the depth T2 of the hole 24*e* corresponding to "No. 2" is set as a reference position in design of the optical axis, adjustment to the gap t1 and the angle ϕ1 shown in FIG. 18C can be achieved by use of the depth T1, and adjustment to the gap t3 and the angle ϕ3 can be achieved by use of the depth T3.

Now, a mechanism of adjusting the image projected on the screen 7 substantially about the center of the image will be described below, referring to FIGS. 1, 2 and 21 to 23.

Figure 21A:
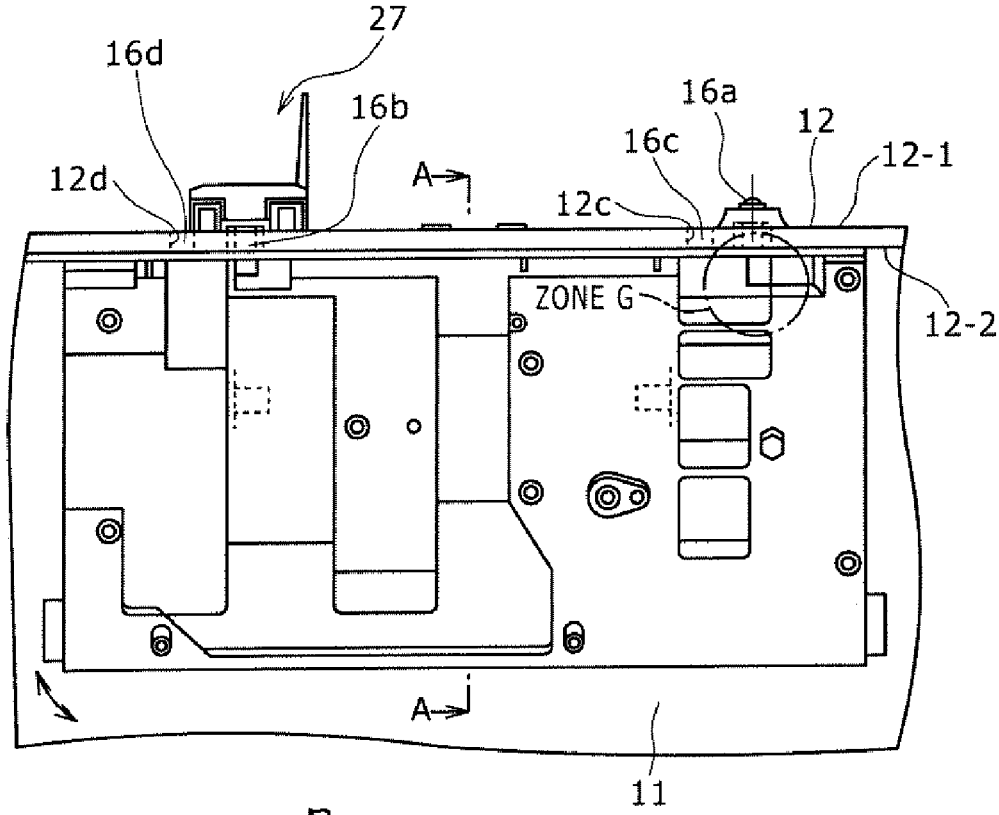
Figure 21B:
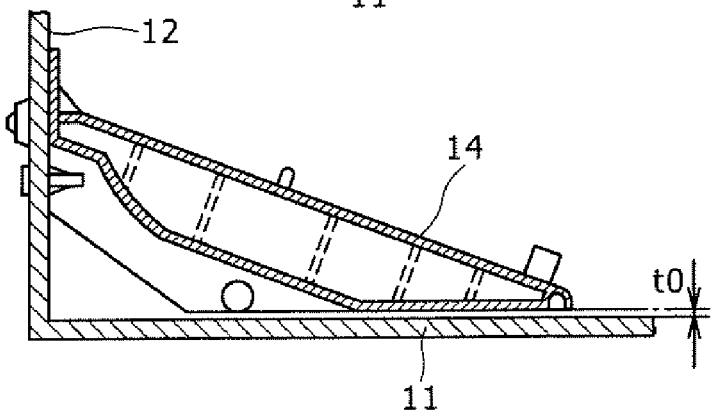

FIG. 21A shows the condition where the positioning holes 12*c* and 12*d* shown in FIGS. 15A and 15B provided in the bottom wall 12 are engaged with the positioning projected parts 16*c* and 16*d* provided on the back plate 14-3 of the optical unit mount plate 14, and the R adjusting plate 27 for adjusting the image substantially about the center of the image is provided; FIG. 21B is a sectional view along line A-A of FIG. 21A, as viewed in the direction of arrows; and FIG. 21C is a side view of FIG. 21A.

Figure 21C:
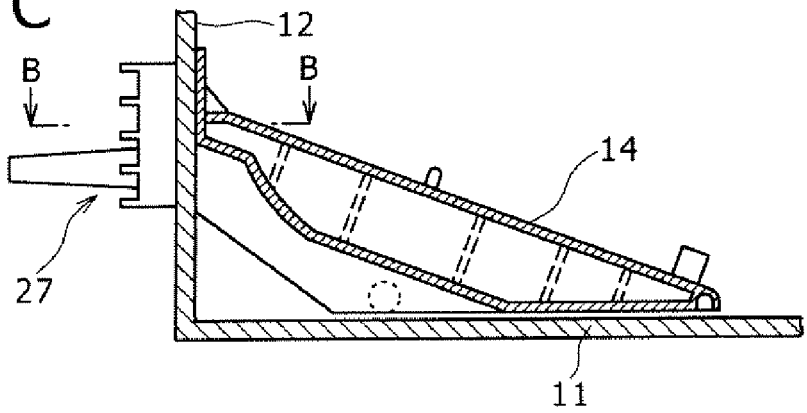

Specifically, there is shown the condition where the ribbed projection 16*a* serving as a fixed end of the optical unit mount plate 14 is fixed to the recessed part 12*a* of the bottom wall 12 shown in FIG. 15B and where the other ribbed projection 16*b* of the optical unit mount plate 14 is fixed by the R adjusting piece 27 (FIG. 21C). In this case, as shown in FIG. 21B which is a sectional view along line A-A of FIG. 21A as viewed in the direction of arrows, the bottom surface 14-2 of the optical unit mount plate 14 is spaced by a gap t0 from the base plate 14 (see FIG. 18A).

The case of changing the protruding amount of the tip face of the ribbed projection 16*b* from the front surface 12-1 of the bottom wall 12 by removing the R adjusting piece 27, starting from the condition where the ribbed projections 16*a* and 16*b* of the optical unit mount plate 14 are fixed to the bottom wall 12, is considered.

In this case, it is understood that, by adjusting the protruding amount of the ribbed projection 16*b*, the optical unit mount plate 14 can be turned, with the zone G near its fixed end of fixation to the ribbed projection 16*a* as a fulcrum of turning.

In this embodiment, as shown in FIG. 2, the turning amount of the optical unit mount plate 14 is adjusted by the R adjusting piece 27 provided on the front side of the bottom cabinet 3, i.e., provided from the front surface 12-1 of the bottom wall 12.

Figure 22A:
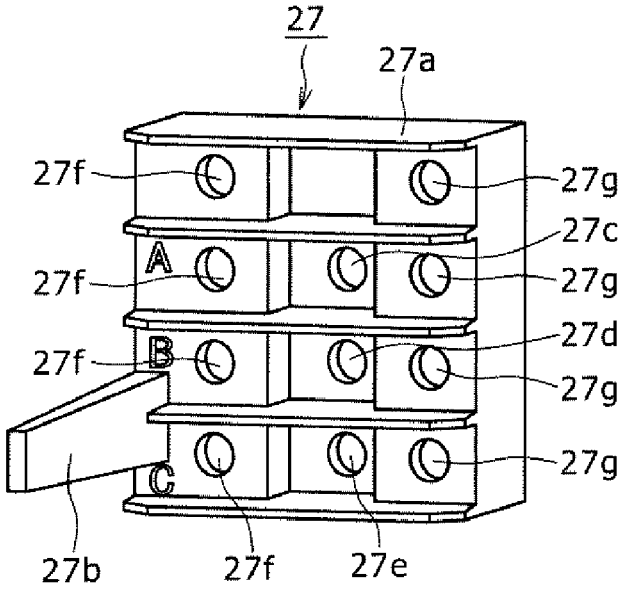
Figure 22B:
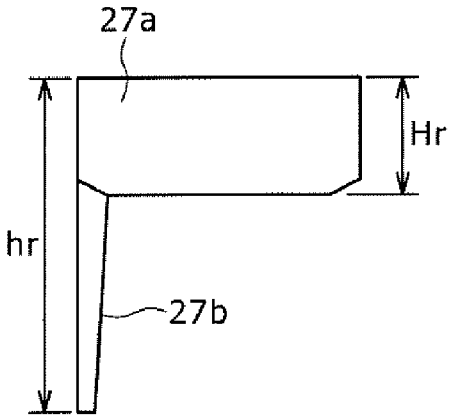
Figure 22C:
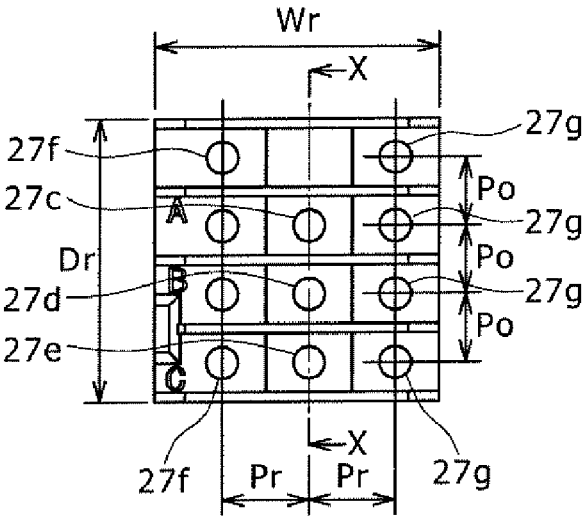
Figure 22D:
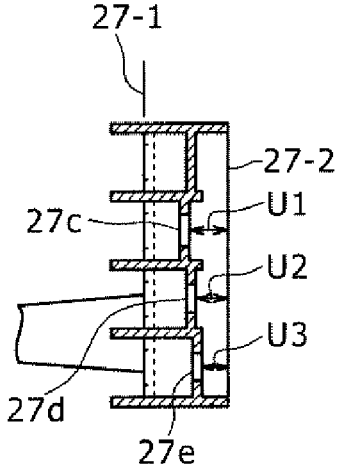
Figure 22E:
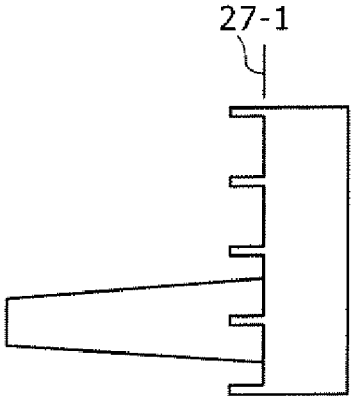
Figure 22F:
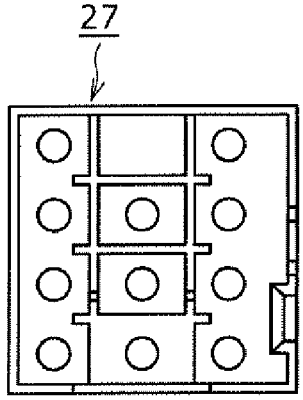

FIGS. 22A to 22F illustrate the shape of the R adjusting piece 27, wherein FIG. 22A is a perspective view, FIG. 22B is a plan view, FIG. 22C is a front view, FIG. 22D is a left side sectional view along line X-X of FIG. 22C, FIG. 22E is a left side view, and FIG. 22F is a back elevation.

The R adjusting piece 27 is produced by, for example, injection molding of a hard plastic resin, and includes a body 27*a* provided with a plurality of screw passing holes, and a lever 27*b* erected on the body 27*a*, as shown in FIG. 22A.

The body 27*a* has a configuration in which four recessed parts aligned in a vertical array are formed substantially at the center, in an upper surface 27-1 shown in FIG. 22E, the upper surface 27-1 is provided with four screw passing holes each on both sides of the four recessed parts, the lower three of the four recessed parts are also provided with screw passing holes, the three surfaces arrayed horizontally are provided as one set, and a partition plate is erected between the adjacent sets (see FIG. 22C).

Here, the holes in the vertical array on the left side in FIG. 22A are denoted by symbol 27*f*, the holes in the vertical array on the right side are denoted by symbol 27*g*, and the holes provided in the recessed part are denoted by symbols 27*c*, 27*d* and 27*e*. In addition, the set of the holes 27*f*, 27*c* and 27*g* arranged in the second partitioned area from the upper side is denoted by "symbol A", the set of the holes 27*f*, 27*d* and 27*g* arranged in the third partitioned area from the upper side is denoted by "symbol B", and the set of the holes 27*f*, 27*e* and 27*g* arranged in the lowermost partitioned area is denoted by "symbol C".

Roughly referring to the size of the R adjusting piece 27 in this embodiment, the height Hr of the body 24*a* shown in FIG. 22B is Hr=17 mm, the height hr to the tip of the lever 27*b* is hr=48 mm, the width Wt of the body 27*a* shown in FIG. 22C is wr=42 mm, and the depth Dr is Dr=43 mm. In addition, as shown in FIG. 22C, the pitch Pr by which the holes 27*f* and 27*g* on both sides are spaced from the holes 27*c*, 27*d*, 27*e* in the recessed part is, for example, Pr=13 mm, the vertical pitch p0 of the holes 27*c* to 27*g* is, for example, p0=14.5 mm, and the diameter of the holes is 4.5 mm.

Besides, where the depths of the holes 27*c*, 27*d* and 27*e* in the recessed parts measured from the bottom surface 27-2 of the recessed parts corresponding to symbols A to C shown in FIG. 22D are denoted respectively by U1, U2 and U3 (U1>U2>U3), for example, U1=4.4 mm, U2=4.0 mm, and U3=3.6 mm.

Attachment of the optical unit mount plate 14 to the bottom wall 12, by using the R adjusting piece 27 formed in this manner, will be described referring to FIGS. 23A to 23D.

FIGS. 23A to 23D are partial plan sectional views of the vicinity of the ribbed projection 16*b* and the positioning projected part 16*d* for fixation on the side where the R adjusting piece 27 is provided, of the optical unit mount plate 14 fixed to the bottom wall 12, as viewed from above along line B-B of FIG. 21C.

Figure 23A:
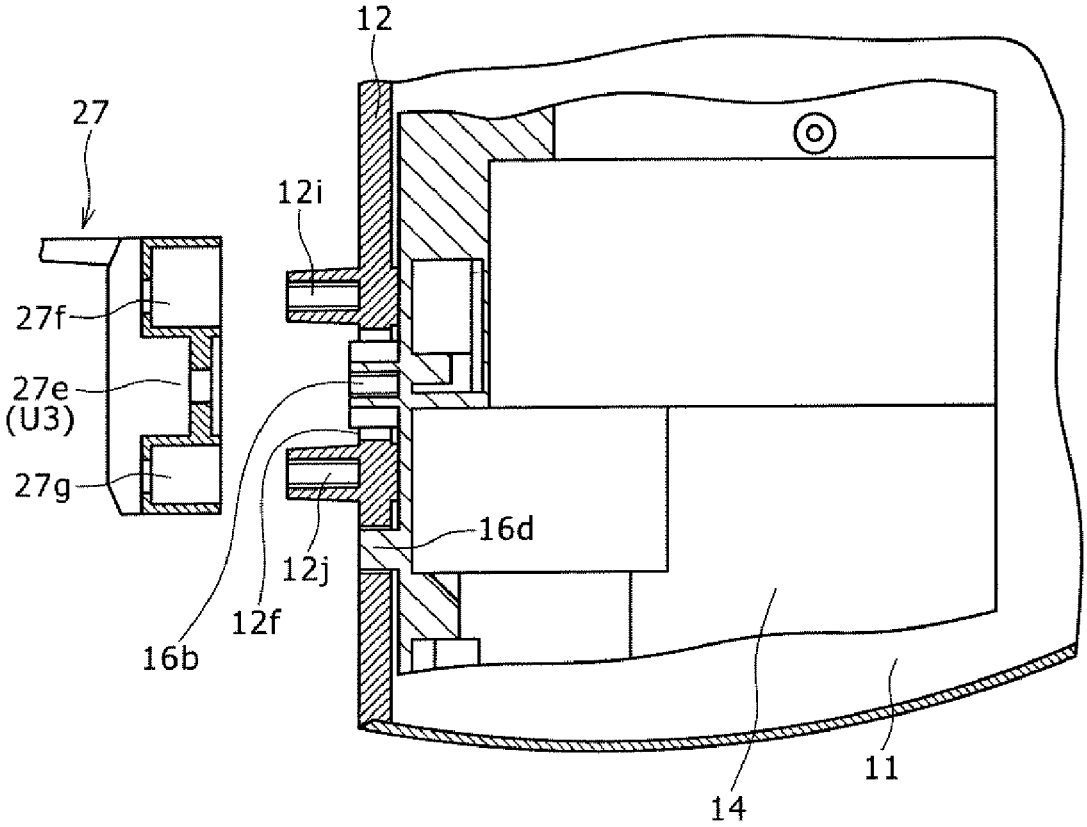

FIG. 23A shows the condition immediately before the R adjusting piece 27 is attached to the optical unit mount plate 14 and the bottom wall 12, in which the screw passing holes 27*f* and 27*g* are disposed respectively opposite to the screw holes 12*i* and 12*j* shown in FIG. 15 in the bottom wall 12. For example, the screw passing hole 27*e* with the depth U3 corresponding to symbol C is aligned to the ribbed projection 16*b* projected from the opening 12*f*.

Figures 23B, 23C, 23D:
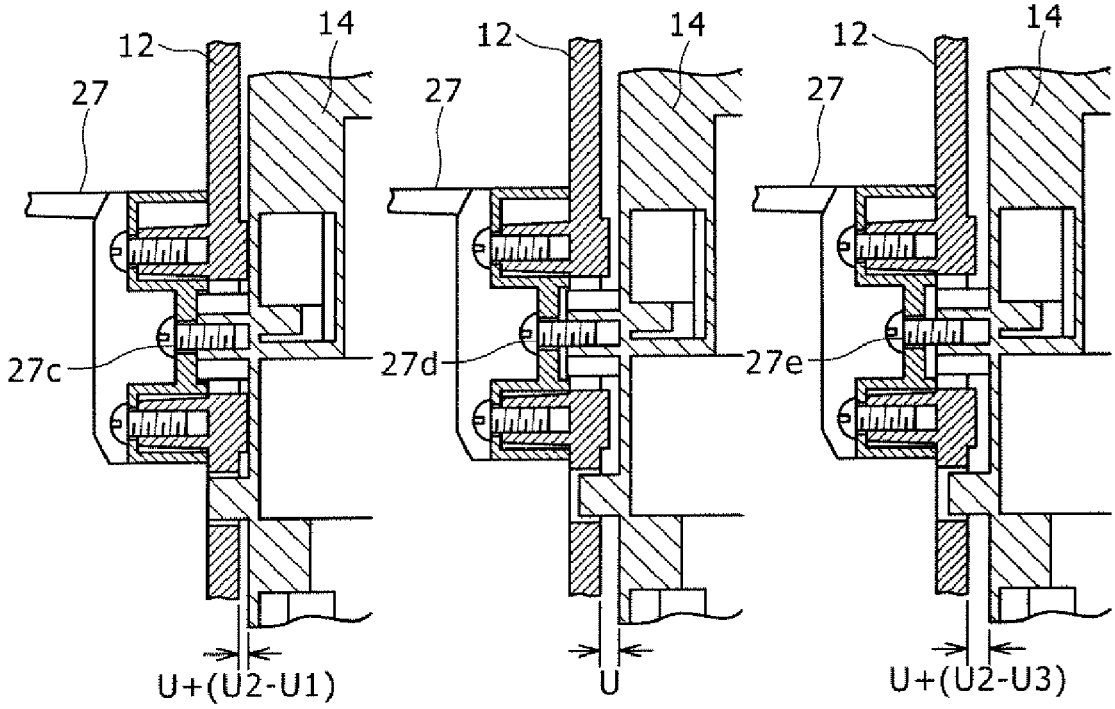
FIG. 23B shows the fixed condition at the screw passing hole of "Symbol A" in FIG. 22C.
FIG. 23C shows the fixed condition at the screw passing hole of "Symbol B" in FIG. 22C.
FIG. 23D shows the fixed condition at the screw passing hole of "Symbol C" in FIG. 22C.

FIG. 23B shows the condition where the portion of "symbol A" shown in FIG. 22 of the R adjusting piece 27 is attached to the optical unit mount plate 14 and the bottom wall 12, FIG. 23C shows the condition where the portion of "symbol B" of the R adjusting piece 27 is attached to the optical unit mount plate 14 and the bottom wall 12, and FIG. 23D shows the condition where the portion of "symbol C" of the R adjusting piece 27 is attached to the optical unit mount plate 14 and the bottom wall 12.

Here, for example, where the condition where the optical unit mount plate 14 is positioned relative to the bottom wall 12 by "symbol B" shown in FIG. 23C is taken as a reference and where the gap between the bottom wall 12 and the optical unit mount plate 14 in this condition is denoted by u, the gap in the case of "symbol A" shown in FIG. 23B is u+(U2−U1), and the gap in the case of "symbol C" shown in FIG. 23D is u+(U2−U3).

In the three attaching positions corresponding to the symbols A to C, the projecting amounts of the ribbed projection 16*b* of the optical unit mount plate 14 from the bottom wall 12 are U1, U2 and U3, respectively. According to the projecting amounts, the optical unit mount plate 14 is turned in such a manner that the vicinity of the zone G shown in FIG. 21 where the optical unit mount plate 14 and the ribbed projection 16*a* of the bottom wall 12 are fixed serves as a fulcrum.

In other words, the optical axis of the projection lens 5 mounted on the optical unit mount plate 14 is turned, though only slightly.

Here, by a method in which the case of the depth U2 of the hole 27*d* corresponding to "symbol B" is used as a reference position in design of the optical axis, the optical axis can be rotated by a predetermined amount clockwise in FIG. 21A in the case of the depth U1, and by a predetermined amount in counterclockwise in the case of the depth U3.

In assembling the rear projection display apparatus configured as above, first, the adjusting plate 17 is mounted onto the base plate 11 and the bottom wall 12 shown in FIG. 14 of the bottom frame 8 of the bottom cabinet 3 shown in FIG. 2, and then the optical unit mount plate 14 with the optical unit 4 preliminarily mounted thereon is so mounted that its engaging projections 15*a* and 15*b* are engaged with the engaging grooves 17*a* and 17*b* in the adjusting plate 17 (FIG. 7).

Then, the ribbed projection 16*a* of the optical unit mount plate 14 is fixed to the recessed part 12*a* of the bottom wall 12, the other ribbed projection 16*b* is fixed to the R adjusting piece 27 by use of the hole 27*d* in the part of "symbol B", for example, and is fixed to the bottom wall 12 by use of the holes 27*f* and 27*g* in the part of "symbol B".

Next, the ribbed projection of the adjusting plate 17 is fixed by use of, for example, the screw passing hole 24*e* of "No. 2" of the V adjusting piece 24, and is then fixed to the bottom wall 12 by use of the screw passing holes 24*d* and 24*f* on both sides.

Then, such apparatuses as a light source, an air cooling fan, and a power source unit are stored in the bottom frame 8, the optical unit 4 is covered with the covers 51, 52 and 53 as shown in FIG. 2, and thereafter the mesh cover 9 is attached, whereby the bottom cabinet 3 is assembled.

Finally, the top cabinet 2 pre-assembled and to be provided at an upper part is mounted on and fixed to the bottom cabinet 3 from the upper side, whereby the rear projection display apparatus in this embodiment is assembled.

According to the rear projection display apparatus configured as above, the fixation of the ribbed projection 18 of the adjusting plate 17 and the V adjusting piece 24 may be changed from "No. 2" in the V adjusting piece 24 to the screw passing hole 24*e* of "No. 1", and then the assembly may be fixed to the bottom wall 12 by use of the screw passing holes 24*d* and 24*f* on both sides, whereby the inclination of the optical unit mount plate 14 can be reduced, and the optical axis of the projection lens 5 can be thereby moved downwards, so that the image on the screen 7 can be shifted toward the lower side. This makes it possible to correct the inverse-trapezoidal distortion in which a rectangular image on the screen 7 is distorted into an inverse-trapezoidal shape.

In addition, by changing the fixation from "No. 2" to the screw passing hole 24*f* of "No. 3", the inclination of the optical unit mount plate 14 can be increased, and the optical axis of the projection lens 5 can be thereby moved upwards, so that the image on the screen 7 can be shifted toward the upper side. This makes it possible to correct the trapezoidal distortion in which a rectangular image on the screen 7 is distorted into a trapezoidal shape.

Besides, the fixation of the ribbed projection 16*b* of the optical unit mount plate 14 and the R adjusting piece 27 may be changed from "symbol B" to the screw passing hole 27*c* of "symbol A", and then the assembly may be fixed to the bottom wall 2 by use of the screw passing holes 27*g* and 27*h* on both side, whereby the optical unit mount plate 14 can be rotated clockwise in FIG. 21A. This makes it possible to rotate the image on the screen 7 clockwise about the center of the image, thereby correcting counterclockwise rotational distortion.

In addition, the fixation may be changed from "symbol B" to the screw passing hole 27*f* of "symbol C", and then the assembly may be fixed to the bottom wall 12 by use of the screw passing holes 27*g* and 27*h* on both sides, whereby the optical unit mount plate 14 can be rotated counterclockwise in FIG. 21A. This makes it possible to rotate the image on the screen 7 counterclockwise about the center of the image, thereby correcting clockwise rotational distortion.

According to the cable clamp 80 which is a cable fixture configured as above, the flexible wiring board 90 fixed assuredly to the shield sheet metal 35 by only pushing in the hook hole 35*a* and led in by the clamp 80*e* so that its wiring direction set substantially orthogonal to the opening 35*b* in the shield sheet metal 35 can be fixed to the shield sheet metal 35, without exerting any mechanical stress on the flexible wiring board 90 itself.

In addition, since the clamp 80*e* can be so provided as to overhang relative to the opening 35*b* in the shield sheet metal 35, there is no need to provide any wiring protective member such as bush, grommet, etc. as an edge guard at the opening 35*b*.

Besides, the cable clamp 80 provided with the conductive elastic body 70 can be fixed while pressing the conductive elastic body 70 against the metallic shield sheet metal 35, whereby the flexible wiring board 90 can be fixed by clamping it between the conductive elastic body 70 and the clamp 80*b* of the cable clamp 80. In this case, the flexible wiring board 90 can be easily grounded by the grounding conductive wiring pattern provided on the face, brought into contact with the conductive elastic body 70, of the flexible wiring board 90.

Since the conductive connection between the flexible wiring board 90 and the shield sheet metal 35 is made through the conductive elastic body 70, a change from the grounded condition to an insulated condition can be easily made by removing the conductive elastic body 70 or by replacing it by an insulating elastic body. Therefore, the selection between grounding and insulation at each location of the shield sheet metal 35 can be made flexibly. In addition, since conductive connection between the shield sheet metal 35 and the flexible wiring board 90 can be made easily and assuredly, a large reduction in working time can be expected, stable conductive connection can be achieved and, therefore, the EMC performance can be stabilized.

According to the cable fixture in this embodiment, by providing the cable fixture in the vicinity of the opening in the sheet metal, the flexible wiring board guided in so that its wiring direction is substantially orthogonal to the opening in the sheet metal can be fixed. Besides, when the cable fixture provided with the conductive elastic body is applied to an electronic apparatus, the flexible wiring board provided with the grounding metal wiring on one surface thereof ensures that the electronic apparatus can be provided with high EMC performance through conductive connection between the metal wiring and the sheet metal.

The cable fixture according to an embodiment of the present invention is not limited to the above-described embodiment, and other various configurations can naturally be adopted within the scope of the gist of the invention. For example, a foam having its outer periphery covered with a conductive fabric has been described as the conductive elastic body, this is not limitative, and a member provided with elasticity and conductivity by use of a rubber elastic material admixed with conductive carbon powder or metallic powder or a thin metallic plate of a foldable structure may be put in contact with the shield sheet metal and the flexible wiring. Besides, while description has been made of the example in which the cable fixture is provided with the rectangular parallelopiped conductive elastic body on two faces on the inside of the L-shaped form of the body, a configuration may be adopted in which a belt-like conductive elastic body is wound thickly around the body so that, when the conductive elastic body is fixed to the shield sheet metal and when the flexible wiring is fixed by the clamp, the shield sheet metal and the conductive elastic body make contact with each other and the flexible wiring and the conductive elastic body make contact with each other.

Furthermore, while description has been made of an example in which the fixation to the sheet metal is made by passing an insertion section 80*b* of the cable clamp 80 through the hook hole 35*a* and hooking a hook section 80*c* of the cable clamp 80 on the hook hole 35*a*, this configuration is not limitative. For example, a configuration may be adopted in which a round rod is integrally provided at its tip with a cone having a base greater than the diameter of the round rod, then a cut having a comparatively large gap is formed in the axial direction of the rod, and the round rod is pushed into a hole formed in the sheet metal, whereby engagement is made at the stepped part of the rod. As the fitting section, an arbitrary one can be adopted.

While a preferred embodiment of the present invention has been described using specific terms, such description is for illustrative purpose only, and it is to be understood that changes and variations may be set without departing from the spirit or scope of the following claims.

What is claimed is:

1. A cable fixture, comprising:

a holding section for holding a cable relative to a chassis; and fitting sections formed integrally with said holding section for fixing said holding section to said chassis;

wherein said cable is fitted by said fitting sections provided at both end portions of said holding section and hooked onto a hole provided in a vicinity of an opening formed in said chassis for permitting said cable to pass therethrough, and wherein a wiring direction of said cable fixed by said holding section coincides substantially with a fixing direction of the chassis fixed by said fitting sections.

2. The cable fixture as set forth in claim 1, wherein a conductive elastic body is clamped between said holding section and said chassis for conduction between said chassis and said conductive elastic body.

3. The cable fixture as set forth in claim 2, wherein said holding section includes:

an L-shaped body section;

a clamp section having one end part connected to one end part of said body section and having another end part locked to other end part of said body section, wherein the clamp section opens and closes in a plane orthoaonal to said cable; and said conductive elastic body is disposed along an inside of said L-shaped body section and clamped between said body section and said chassis, and said cable is clamped between said conductive elastic body and said clamp section.

4. The cable fixture as set forth in claim 1, wherein when said holding section is fixed to said chassis by said fitting sections, and wherein said cable fixed by said holding section is passed substantially through a center of said opening in said chassis.

* * * * *